US006230964B1

(12) United States Patent
Saito

(10) Patent No.: US 6,230,964 B1
(45) Date of Patent: May 15, 2001

(54) PROTRUDING CASE FOR MAIL

(76) Inventor: Toshiki Saito, c/o Toshiki Saito Design Room 4-13-8, Minamisenba, Chuo-ku, Osaka-shi, Osaka 542-0081 (JP)

( * ) Notice: Subject to any disclaimer, the term of this patent is extended or adjusted under 35 U.S.C. 154(b) by 0 days.

(21) Appl. No.: 09/269,810

(22) PCT Filed: Sep. 29, 1997

(86) PCT No.: PCT/JP97/03480

§ 371 Date: Apr. 23, 1999

§ 102(e) Date: Apr. 23, 1999

(87) PCT Pub. No.: WO98/14389

PCT Pub. Date: Sep. 4, 1998

(30) Foreign Application Priority Data

| | | |
|---|---|---|
| Oct. 1, 1996 | (JP) | 8-281423 |
| Dec. 18, 1996 | (JP) | 8-337810 |
| Feb. 5, 1997 | (JP) | 9-022510 |
| Mar. 31, 1997 | (JP) | 9-081107 |
| Jun. 13, 1997 | (JP) | 9-156656 |

(51) Int. Cl.[7] ..... B65D 27/04

(52) U.S. Cl. ..... 229/92.8; 229/71; 206/462; 206/463; 206/470

(58) Field of Search ..... 229/92.8, 71, 72; 206/462, 463, 464, 465, 467, 470

(56) References Cited

U.S. PATENT DOCUMENTS

| | | | |
|---|---|---|---|
| 1,011,697 | 12/1911 | Witkowski | 206/462 |
| 2,568,625 | 9/1951 | Harvey | 206/464 X |
| 2,993,590 | 7/1961 | Denton | 206/462 X |
| 3,111,220 | 11/1963 | Bostrom | 206/470 X |
| 3,184,319 | 5/1965 | Fritsche | 206/462 X |
| 4,210,246 | 7/1980 | Kuchenbecker | 206/467 X |
| 4,951,404 | 8/1990 | Lithwick | 206/462 X |
| 5,119,952 | 6/1992 | Warriner, Jr. | 206/462 |
| 5,154,293 | 10/1992 | Gould | 206/467 X |
| 5,476,951 | 12/1995 | Weaver | 206/470 X |
| 5,607,101 | 3/1997 | Saito | 229/92.8 X |

FOREIGN PATENT DOCUMENTS

| | | | |
|---|---|---|---|
| 0 473 190 | 3/1992 | (EP) | 229/92.8 |
| 2 422 559 | 12/1979 | (FR) | 229/92.8 |
| 4-68861 | 6/1992 | (JP) . | |
| 6-57854 | 8/1994 | (JP) . | |
| 8-143059 | 6/1996 | (JP) | 229/92.8 |

*Primary Examiner*—Jes F. Pascua
(74) *Attorney, Agent, or Firm*—Jordan and Hamburg LLP

(57) ABSTRACT

A postal package includes first and second sheet portions, at least one of which includes a cut-out window, and an inner case interposed between the first and second sheet portions. The inner case is constituted by a cup having a mouth and an outwardly extending flange portion around the mouth and by a cover dimensioned to close the mouth of the cup. At least one of the cup and the cover includes engagement structure for mutual engagement one to the other. Such engagement structure is defined by inter-engaging surfaces of the cup and the cover. The cup is dimensioned to protrude through the cut-out window. In a further embodiment, the cover can additionally present a cup shape, dimensioned to protrude from another cut-out window formed in the other of the first and second sheet portions.

17 Claims, 30 Drawing Sheets

84
83B
83C
83D
83A
direction of x 84
85
83B
83C
83A
δ
δ

83B
83C
83A 84
83B
83D'
83C
83A 84
85
83B
83C
83D'
83A 83B
83D'
83A

PROTRUDING CASE FOR MAIL

TECHNICAL FIELD

The present invention relates to a protruding postal matter case, which is fixed between a first sheet portion forming a part of the postal matter and a second sheet portion having a cut-out window portion and laid over the first sheet portion to be closed in the form of the postal matter and protrudes from the out-out window portion. The present invention particularly relates to a variety of protruding postal matter cases adapted to be suitable for automation for mass production thereof.

BACKGROUND ART

The protruding postal matter case 104 defined herein indicates, for example, a case 104 shown in FIG. 29 which is fixed between a first sheet portion 101 forming a front side of a post card-like postal matter and a second sheet portion 103 forming a back side having a cut-out window portion 102 and laid over the first sheet portion 101 to be closed in the form of the postal matter and protrudes from the cut-out window portion 102.

Examples of the conventional type of protruding postal matter cases are shown in FIGS. 30(*a*) and 30(*b*). The protruding postal matter case 105 shown in FIG. 30(*a*) has a cup-like form, comprising a convex portion 106 having a space therein and a flange portion 107 therearound. The flange portion 107 is fixed between the first sheet portion 101 and the second sheet portion 103.

The protruding postal matter case 108 shown in FIG. 30(*b*) comprises a cup and a cover 109 having the same shapes as the one shown in FIG. 30(*a*). In this type of protruding postal matter case, the flange portion 107 and the cover 109 are fixed between the first sheet portion 101 and the second sheet portion 103.

The protruding postal mater case provides the following advantageous effects.

When a postal matter having the protruding postal matter case is used for a direct mail, a door-to-door delivery service and an advertising medium by disposition or posting, not only an advertising printing matter but also a sample of an article or a small actual article can be mailed together, with contained in the case, and a recipient or an addressee can visually confirm the literature and information and the sample and also try the sample actually by touch with it. Further, when the case is made transparent, the recipient or addressee can realize what is the article contained in the postal matter at the moment when he has received the postal matter. Besides, the stereoscopic postal matter can catch the recipient's eyes to contribute to enhance the percentage of an opening of the postal matter and also directly appeal to the recipient or addressee.

When casing therein a small article such as a sample of an article, the case 105 shown in FIG. 30(*a*) requires the step that after a glue or a double-coated tape is applied to the flange portion 107, the first sheet portion is adhesive bonded to the flange portion to close the inner space of the convex portion 106 by the first sheet portion. On the other hand, the case shown in FIG. 30(*b*) requires the step that after the glue or the double-coated tape is applied to the flange portion 107, the cover 109 is adhesive bonded to the flange portion to close the inner space of the convex portion 106 by the cover.

Incidentally, when an attempt is made to achieve mass production of the protruding postal matter case by automation, the inner space of the convex portion 106 must be closed in advance to prevent the sample or something contained in the cup from coming out of the same. However, the application of the glue to the flange portion 107 only, without adhering to the sample or equivalent, requires high accuracy and thus involves difficulties. On the other hand, the application of the double-coated tape to the same involves disadvantages of requiring a manual working and being costly and thus increasing unit costs.

In the light of the disadvantages mentioned above, the present invention has been made. It is the object of the present invention to provide a protruding postal matter case suitable for automation for mass production thereof.

DISCLOSURE OF THE INVENTION

To achieve the abovesaid object, the first protruding postal matter case of the present invention is directed to a protruding postal matter case which is fixed between a first sheet portion forming a part of a postal matter and a second sheet portion having a cut-out window portion and laid over the first sheet portion to be closed in the form of the postal matter and protrudes from the cut-out window portion. The protruding postal matter case comprises a cup having a space therein and a flange portion therearound; a cover for closing the inner space of the cup; and at least one engaging means for bringing the cover and the cup into engagement with each other, wherein the flange portion of the cup and the cover are sandwiched between the first sheet portion and the second sheet portion such that the cup is protruded from the cut-out window portion.

The engaging means is formed by a closing member for hooking one of the cover and the flange portion over the other of the cover and the flange portion, to close them. To be concrete, the engaging means may comprise a notch arranged in the cover at a position thereof to be laid over the flange portion of the cup; and the flange portion of the cup inserted in the notch. Alternatively, the engaging means may comprise a notch arranged in the flange portion of the cup at a position thereof to be laid over a marginal portion of the cover; and the marginal portion of the cover inserted in the notch.

The engaging means comprising the notch arranged in the cover; and the flange portion of the cup inserted in the notch enables the cover to be flattened on a side thereof to contact with the first sheet portion, thus facilitating the gluing of the cover to the first sheet portion. At least one of the flange portion of the cup and the marginal portion of the cover may be inserted in notches at positions in the neighborhood of a larger diameter side of the first sheet portion to be laid over the cut-out window portion of the second sheet portion.

This also facilitates the fixing of the protruding postal matter case to the first sheet portion.

Also, the engaging means comprising the notch arranged in the flange portion of the cup; and the marginal portion of the cover inserted in the notch enables the flange portion of the cup to be flattened at a side thereof to contact with the second sheet portion. This facilitates the intimate contacting of the protruding postal matter case having the cut-out window portion in the second sheet portion and ensures the fixing of the case to the second sheet portion.

Referring now to the second protruding postal matter case of the present invention, it is directed to a protruding postal matter case which is fixed between a first sheet portion forming a part of a postal matter and a second sheet portion having a cut-out window portion and laid over the first sheet portion to be closed in the form of the postal matter and which protrudes from the cut-out window portion. The second protruding postal matter case comprises a cup having a space therein and a flange portion therearound; a cover for closing the inner space of the cup; an adhesive means for allowing the cover and the flange portion of the cup to adhere to each other; and fixing means, provided in the cover, for fixing the cover to the first sheet portion or fixing means, provided in the flange portion, for fixing the flange portion of the cup to the cut-out window portion of the second sheet portion, wherein the flange portion of the cup and the cover are sandwiched between the first sheet portion and the second sheet portion such that the cup is protruded from the cut-out window portion of the postal matter.

Further, the third protruding postal matter case of the present invention is directed to a protruding postal matter case comprising a disc-shaped cup having a disc-like inner space for receiving therein a disc-like article of a given thickness having a through bore of a given size at the center thereof and a flange portion therearound; and a cylindrical projection which has such a diameter as to fit in the given sized through bore of the disc-like article in such relation as to be resistant to disengagement therefrom and a height larger than the given thickness of the disc-like article and projects to the inner space of the disc-shaped cup at the center thereof.

In the third protruding postal matter case of the present invention, the flange portion of the disc-shaped cup is fixed in sandwich relation between the first sheet portion forming a part of the postal matter and the second sheet portion having a cut-out window portion and laid over the first sheet portion to be closed in the form of the postal matter, such that the disc-shaped cup is protruded from the cut-out window portion of the postal matter. The third protruding postal matter case itself may be used as the first sheet forming a part of the postal matter of the size of a standard-size mail, and the inner space of the disc-shaped cup portion may then be closed by the second sheet forming a part of the postal matter.

Further, it is preferable that the first and the third protruding postal matter cases of the present invention are integrally formed from a sheet. In addition, it is preferable for any of the protruding postal matter cases that the first and second sheet portions are formed from a sheet being folded several times so that its periphery can be closed to form a pocket therein, whereby the first and second sheet portions form a part of the postal matter in which paper, such as a mail letter, a photograph and the like, is inserted in the pocket in sealed relation.

According to the first protruding postal matter case of the present invention including the engaging means for bringing the cover and the cup into engagement with each other, the need for applying adhesives, such as a glue and a double-coated tape, to the flange portion of the cup can be eliminated. As a result of this, material costs for adhesives can be reduced and thus unit costs do not increase. Also, the need for positional accuracy for applying adhesive to the flange portion of the cup in the production process can be eliminated, resulting in the protruding postal matter case suitable for mass production.

Further, the engaging means, formed by the closing member for hooking one of the cover and the flange portion over the other of the cover and the flange portion to close them, enables the removal of the cover from the cup to be facilitated, to enable the content to be taken out without damaging the protruding postal matter case. In addition, two or more engaging means, when provided, can ensure the engagement of the cover and the cup to prevent a small article contained in the inner space of the cup from coming out of the protruding postal matter case.

Also, in the case of the engaging means comprising the notch arranged in the cover or the flange portion; and the flange portion of the cup or the marginal portion of the cover inserted in the notch, the engaging means can be formed by a simple process of making the notch, thus contributing to reduction in material costs and production costs. Also, the removal of the cover from the cup can be achieved by simply disengaging the flange portion of the cup or the marginal portion of the cover from the notch, thus facilitating the take-out of the content from the case, without damaging the case.

Further, the notch of the engaging means arranged in the cover enables the cover to be flattened at a side thereof to contact with the first sheet portion, thus ensuring the fixing of the protruding postal matter case to the first sheet portion. When a glue or equivalent is used as the fixing means for fixing the cover to the first sheet portion, that does not require such a high accuracy for a location for the glue or equivalent to be applied, thus facilitating the fixture. Also, the glue is cheap, as compared with the double-coated tape, and thus contributes to reduction in production unit costs. Also, in the case where the protruding postal matter case is fixed to the first sheet portion by inserting at least one of the marginal portion of the cover and the flange portion of the cup in the notches in the first sheet portion, the fixing means for the protruding postal matter case can be formed by a simple process of making a notch in the first sheet portion, thus contributing to reduction in material costs and production costs. Also, the removal of the protruding postal matter case from the postal matter can be achieved by simply disengaging the marginal portion of the cover and its related portion from the notch, thus facilitating the take-out of the content from the case, without damaging the postal matter itself.

Further, the notch of the engaging means arranged in the flange portion enables the flange portion of the cup to be flattened at a side thereof to contact with the second sheet portion, thus ensuring the fixing of the protruding postal matter case in the notch in the second sheet portion. Particularly, when the flange portion of the cup is in intimate contact with the cut-out window portion of the second sheet portion, the trouble of different postal matter being inserted in between the flange portion of the cup and the second sheet portion can be avoided when large amounts of postal matters are handled automatically.

Also, according to the second protruding postal matter case of the present invention, the cover and the cup are adhesive bonded to each other by thermocompression bonding or equivalent. This can eliminate the need for the application of adhesives, such as a glue and a double-coated tape, to the flange portion of the cup. As a result of this, the need for high accuracy for applying adhesive to the flange portion of the cup only can be eliminated from the production process and increase of unit costs can be avoided, resulting in the protruding postal matter case suitable for mass production. Also, since the cover is flattened at a side thereof to contact with the first sheet portion, the protruding postal matter case can be reliably placed in the first sheet portion. When a glue or equivalent is used as the fixing means for fixing the cover to the first sheet portion, that does not require such a high accuracy for a location for the glue or equivalent to be applied, thus facilitating the fixture. In addition, when the flange portion of the cup is fixed to the cut-out window portion of the second sheet portion, the trouble of a different postal matter being inserted in between the flange portion of the cup and the second sheet portion can be avoided when large amounts of postal matters are handled automatically.

According to the third protruding postal matter case of the present invention, since the case is provided at a center thereof with the cylindrical projection having such a diameter as to fit in a given sized through bore at a center of the disc-like article of a given thickness in such relation as to be resistant to disengagement therefrom and a height larger than the given thickness of the disc-like article, the disc-like article received in the inner space of the disc-shaped cup is prevented from being easily disengaged from the protruding postal matter case, resulting in the protruding postal matter case suitable for the mass production. Further, when the third protruding postal matter case itself is formed from the first sheet forming a part of a postal matter of the size of the standard-size mail, the standard-size mail can be made by simply closing the inner space of the disc-shaped cup portion by the second sheet forming a part of the postal matter. This facilitates the forming of the case in the postal matter, resulting in the protruding postal matter case more suitable for the mass production. Also, since the postal matter thus produced is a standard-size mail, it can be mailed cheaply and thus is suitable for a direct mail.

In addition, when the first and second protruding postal matter cases of the present invention are integrally formed from a sheet, that can contribute to the saving of material costs and simplification of the production process. Further, when the postal matter to which the first, second or third protruding postal matter case is fitted is a simple postal matter formed by a sheet being folded several times so that its periphery can be closed to form therein a pocket in which paper, such as a mail letter, a photograph and the like, is inserted in sealed relation, production costs and production time can be reduced as a synergistic effect with the protruding postal case suitable for mass production.

BRIEF DESCRIPTION OF THE DRAWINGS

FIG. 1(*b*), FIG. 2(*b*), FIG. 3(*b*), FIG. 4(*a*), FIG. 5(*a*), FIG. 6(*a*), FIG. 7(*a*), FIG. 9(*a*) and FIG. 10(*a*) are perspective views of the first protruding postal matter cases of the present invention which are in the opened state; FIG. 1(*c*), FIG. 2(*c*) and FIG. 3(*c*) are side views of the first protruding postal matter cases of the present invention which are in the closed state; FIG. 1(*d*); FIG. 12(*b*) is a showing of the second protruding postal matter case of the present invention fitted to the postal matter; FIG. 16(*b*) is a sectional view taken along the line A—A of FIG. 16(*a*)

BEST MODE FOR CARRYING OUT THE INVENTION

Figure 1A:
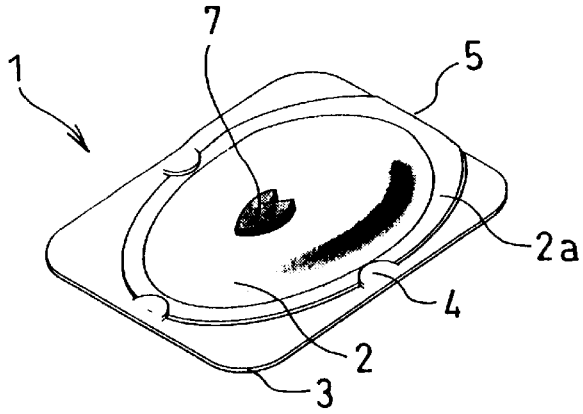
FIG. 1(*a*), FIG. 2(*a*), FIG. 3(*a*), FIG. 4(*b*), FIG. 5(*b*), FIG. 6(*b*), FIG. 7(*b*), FIG. 9(*b*) and FIG. 10(*b*) are perspective views of first protruding postal matter cases of the present invention which are in the closed state.
Figure 1B:
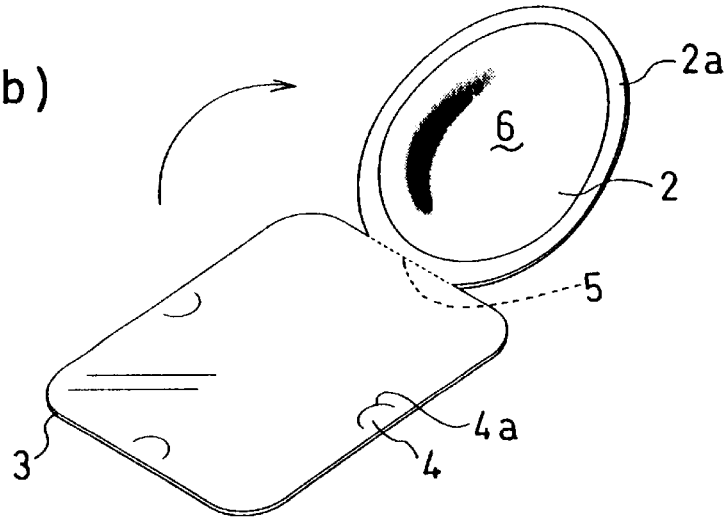
Figure 1C:
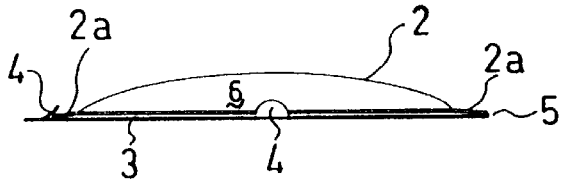
Figure 1D:
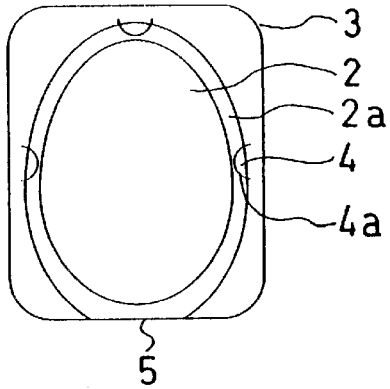
Figure 2A:
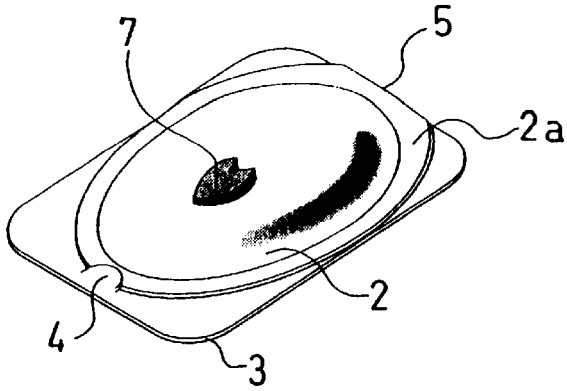
FIG. 2(*d*) and FIG. 3(*d*) are top views of the first protruding postal matter cases of the present invention which are in the closed state.
Figure 2B:
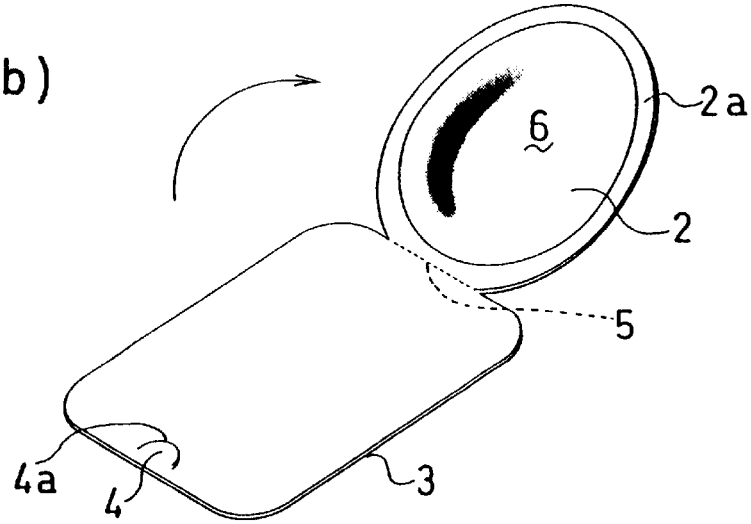
Figure 2C:
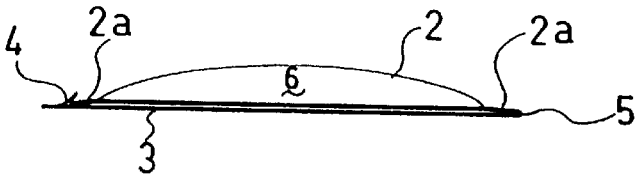
Figure 2D:
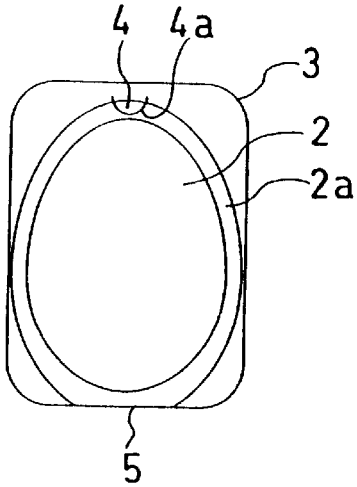
Figure 3A:
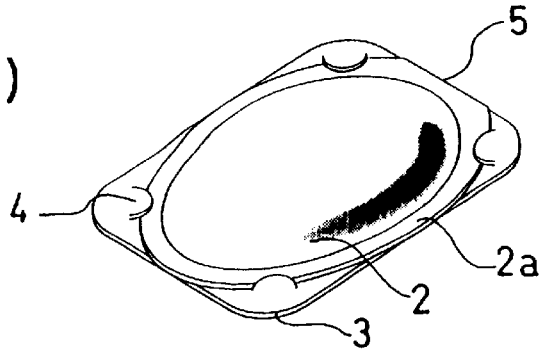
Figure 3B:
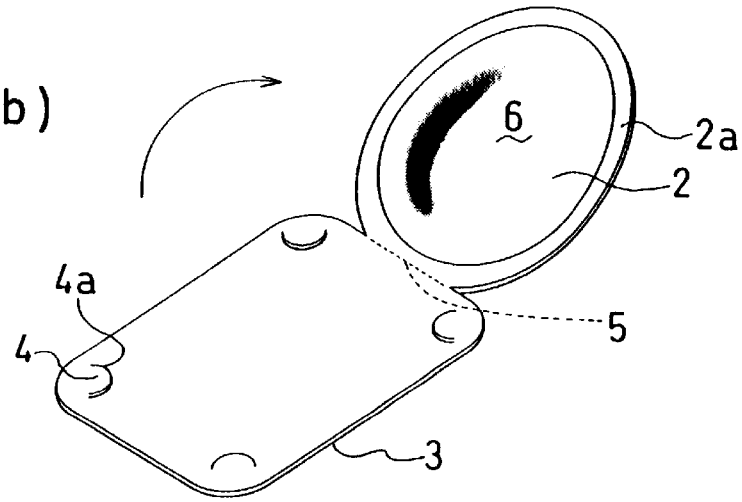
Figure 3C:
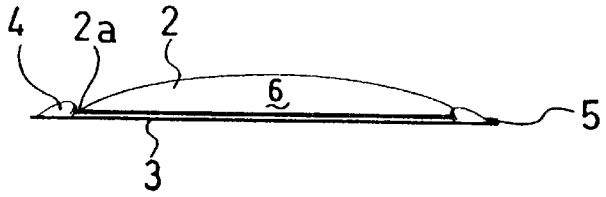
Figure 3D:
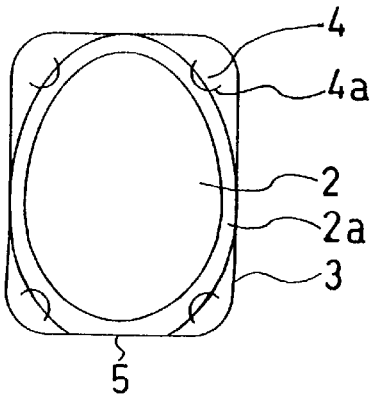

The embodiments of the present invention will be described below with reference to the accompanying drawings.

In the first protruding postal matter cases of the present invention shown in FIGS. 1(*a*) to 7(*b*), engaging means is formed by closing means via which one of a cover and a flange portion is hooked over the other of the cover and the flange portion to close the case.

In FIGS. 1(*a*) to 5(*b*), the engaging means is provided in the cover 3 on a side thereof engaging with the flange portion 2*a* of the cup such that a surface of the cover 3 on a side thereof contacting with the first sheet portion can be kept flat. Keeping flat the surface of the cover on its side contacting with the first sheet portion can ensure the fixing of the protruding postal matter case to the first sheet portion. Besides, when a glue or equivalent is used as the fixing means for fixing the cover to the first sheet portion, that does not require such a high accuracy for a location for the glue or equivalent to be applied, thus facilitating the fixture.

Now, the protruding postal matter case of the present invention shown in FIGS. 1(*a*) through 1(*d*) will be detailed below. FIG. 1(*a*) is a perspective view of the case which is in the closed state; FIG. 1(*b*) is a perspective view of the case which is in the opened state; FIG, 1(*c*) is a side elevation view of the case which is in the closed state; and FIG. 1(*d*) is a top view of the case which is in the closed state.

Shown in FIG. 1(*a*) is a double folded protruding postal matter case having a cover 3 and a cup 2 which are formed in one piece. The protruding postal matter case 1 comprises the cup 2 having an inner space 6 formed by an egg-like curved surface and the flange portion 2*a* therearound; the plate-like cover 3 for closing the inner space 6 of the cup 2; and an engaging means 4 for bringing the cover 3 and the cup 2 into engagement with each other.

The cup 2, cover 3 and engaging means 4 of the double-folded protruding postal matter case 1 are usually formed in one piece by a press by which the blanking and the intrusion process can be done simultaneously, in consideration of productivity and cost efficiency. At a boundary between the cover 3 and the flange portion 2*a*, a thin-wall plate or a crease 5 of a broken line formed by a cutting edge is formed (See FIG. 1(*b*)). The protruding postal matter case 1 thus formed has such a configuration that the cover 3 and the flange portion 2*a* can automatically be laid over each other with reference to the creation 5 via resilience of plastics.

Three clamp-shaped or U-shaped notches 4*a* are notched in the cover 3 from a slightly larger diameter side thereof with respect to a position at which the cover 3 is laid over the outer periphery of the flange portion 2*a*. The notches 4*a* have the clamp-shaped form or the U-shaped form projecting to a smaller diameter side with respect to a position at which the cover is laid over the outer periphery of the flange portion 2*a* (See FIG. 1(*c*)). These notches 4*a* can be formed at the same time as the press molding. Part of the engaging means is formed by pawls 4 edged by the notches 4*a*, together with the flange portion 2*a*. The tip ends of the pawls 4 are pushed in toward the cup 2 through the use of resiliency of the cover 3 so as to be hooked over the flange portion 2*a* of the cup 2, and thereby the flange portion 2*a* is held in sandwich relation between the pawls 4 and the cover 3. Then, the cup 2 and the cover 3 are maintained in their closed state, as shown in FIG. 1(*a*). These engaging means, provided on a surface of the cover 3 on the side thereof engaging with the cup 2, enables a surface of the cover on the side thereof contacting with the first sheet portion forming a part of the postal matter, i.e., a surface of the cover opposite a surface of the cover on the side thereof engaging with the cup 2 to be kept flat. The number of engaging means may be determined on an as needed basis. Though there are provided three engaging means in the illustration of FIG. 1(*a*), for example when a small article of a relatively large size is contained in the inner space, only one engaging means may be located opposite the crease 5, as shown in FIG. 2(*b*), to prevent the small article from coming out of the inner space 6.

Fixing at four locations as shown in FIG. 3(*b*) can minimize the size of the cover 3.

Plastics including a variety of resins may be used for the case. In consideration of environmental issues, biodegradable plastics capable of being completely decomposed into water and carbon dioxide gas by bacteria or resins capable of being reprocessed should preferably be used. Paper may be used for a high-pressure molding, though it is somewhat inferior in hardness. The protruding postal matter cases illustrated in FIGS. 1(*a*) to 3(*d*), which are so designed as to contain a small article in the inner space 6, are made transparent in their entiety so that one can see the small article from outside. The protruding postal matter case may alternatively be made opaque or trauslucent or may be colored gold, silver and any other colors.

Next, the steps of containing a small article 7 will be described. First, in FIG. 1(*b*), the small article 7 is put in the inner containing space 6 of the cup 2. After completion of the putting of the small article in the inner space, the cover 3 is folded along the crease 5 in the direction of the arrow. Then, the case is turned over to bring the cup 2 to the top. Subsequently, through the use of resiliency of the cover 3, the tip ends of the pawls 4 are raised up toward the cup 2 to be hooked over the flange portion 2*a* of the cup 2, and thereby the flange portion 2*a* of the cup is held in sandwich relation between the pawls 4 and the cover 3. Then, the small article 7 contained in the cup 2 is enclosed as shown in FIG. 1(*a*) to be integral with the protruding postal matter case 1. This protruding postal matter case 1 integral with the small article 7 prevents the small article 7 from coming out of the cup 2 when the case 1 is fixed to the sheet member forming the postal matter. As a result of this, a fixing work of the protruding postal matter case 1 to the first or second sheet portion forming a part of the postal matter is facilitated. When the small article 7 is taken out of the cup 2, it is simply required that the tip ends of the pawls 4 are raised up toward the cup 2 through the use of resiliency of the cover 3, so that the flange portion 2*a* of the cup 2 is released from the pawls.

Figure 4A:
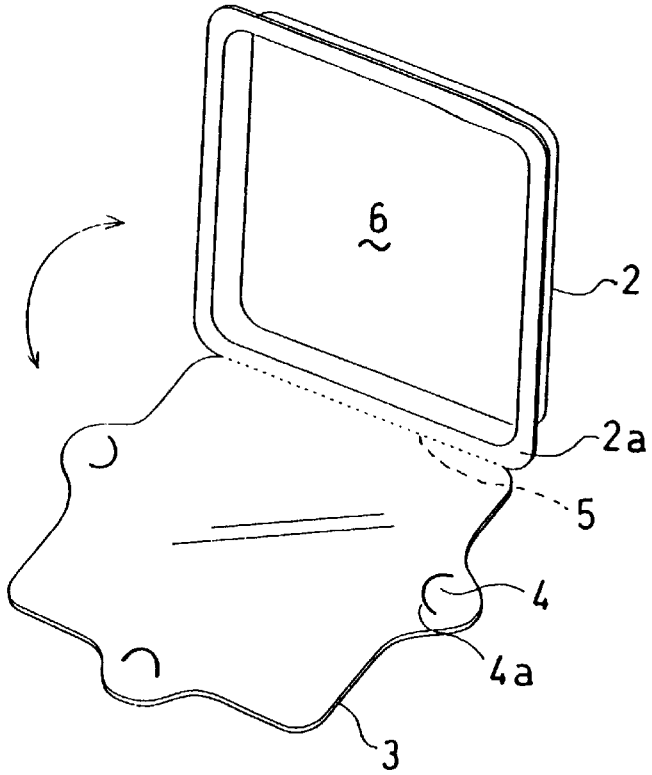
Figure 4B:
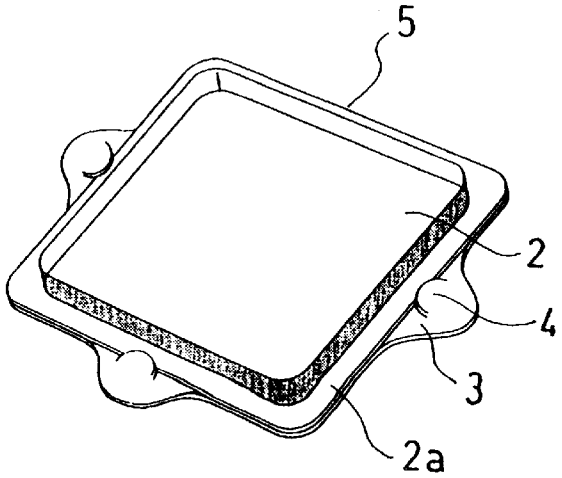
Figure 5A:
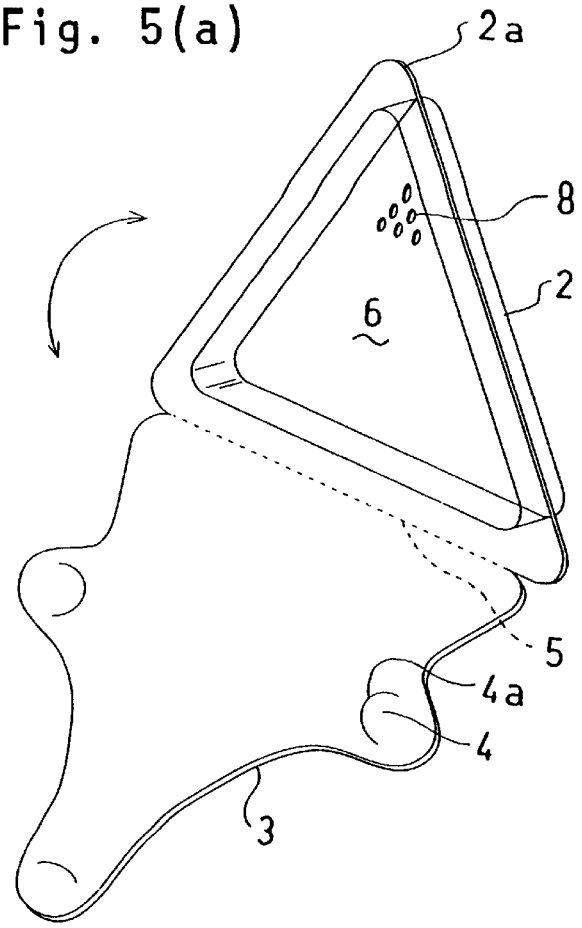
Figure 5B:
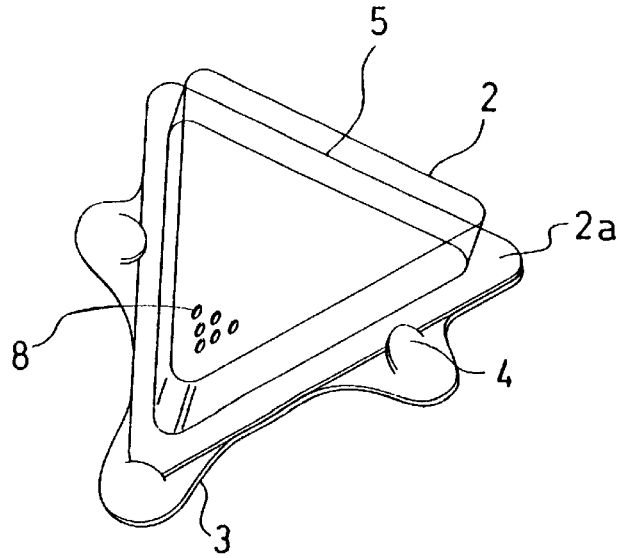

The cover 3 and the cup 2, which in the illustrated double-folded protruding postal matter cases shown in FIGS. 1(*a*) to 5(*b*) are integrally formed with each other, may be formed separate from each other. In addition, the cup 2 may take a variety of forms including a square and a triangle, as shown in FIGS. 4(*a*) to 5(*b*), without being limited to the egg-like curved surface. The covers 3 of the protruding postal matter cases shown in FIGS. 4(*a*) to 5(*b*) are all minimized in size for provision of the engaging means 4. Also, the protruding postal matter cases shown in FIGS. 5(*a*) and 5(*b*) have some small holes 8 and thus are suitable for containing grains of fragrance. The holes 8 may be covered with a removable seal so that when the seal is pealed off as needed, a faint smell of the fragrance can be enjoyed through the holes 8.

Figure 6A:
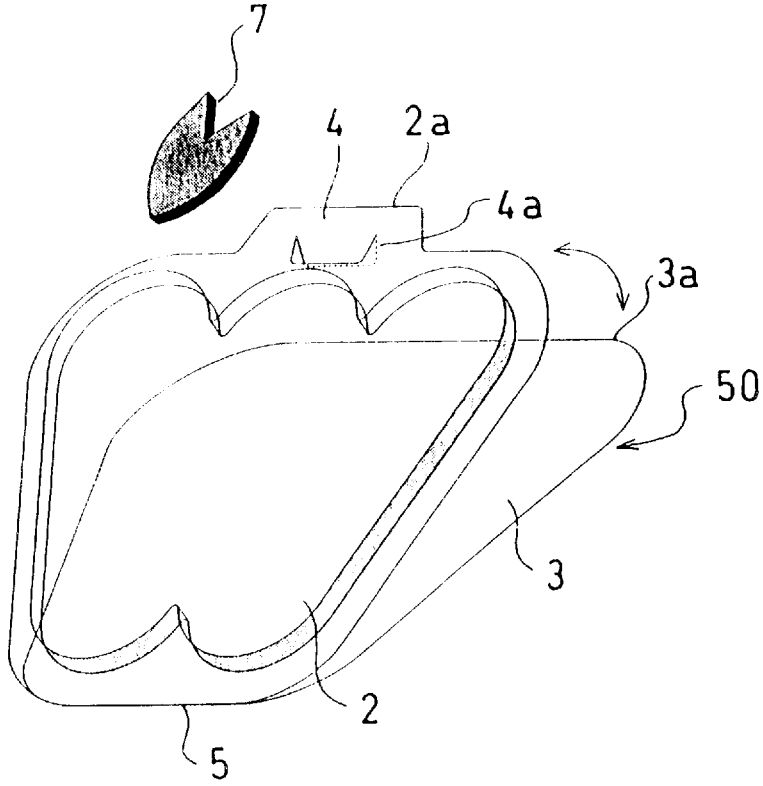
Figure 6B:
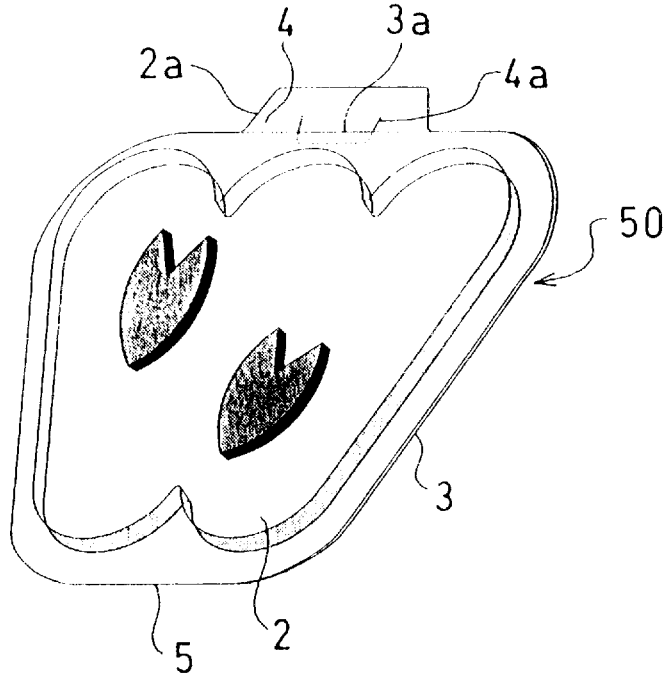

Referring now to FIGS. 6(*a*) to 7(*b*), description will be given on the protruding postal matter cases in which the engaging means 4 is located in the flange portion 2*a* of the cup on a side thereof engaging with the cover 3 so that a surface of the flange portion 2*a* on a side thereof contacting with the second sheet portion can be kept flat. By keeping flat the surface of the flange portion on the side thereof contacting with the second sheet portion having the cut-out window portion forming a part of the postal matter, i.e., the surface of the flange portion 2*a* which is opposite the surface on the side thereof engaging with the cover 3, improved adhesive joining is provided between the flange portion and the second sheet portion at the cut-out window portion.

The protruding postal matter case 50 shown in FIGS. 6(*a*) and 6(*b*) comprises the cup 2 having a W-shaped configuration, the plate-like cover 3 for closing the inner space 6 of the cup 2, and engaging means 4 for bringing the cover 3 and the cup 2 into engagement with each other. The cup 2 has the space 6 therein and the flange portion 2*a* therearound, as in the case of the protruding postal matter case shown in FIG. 1(*a*).

In FIG. 6(*a*), a clamp-shaped or U-shaped notch 4*a* is notched in the flange portion 2*a* at a location opposite the crease 5, extending from a slightly larger diameter side thereof with respect to a position at which the flange portion is laid over a marginal portion of the cover 3. The notch 4*a* has a clamp-shaped form or a U-shaped form projecting to a smaller diameter side with respect to a position at which the flange portion is laid over the marginal portion 3*a* of the cover. This notch 4*a* can be formed at the same time as the press molding.

Part of the engaging means is formed by pawl 4 edged by the notch 4*a*, together with the marginal portion 3*a* of the cover.

The tip end of the pawl 4 is pushed in toward the cover 3 through the use of resiliency of the flange portion 2*a* so as to be hooked over the marginal portion 3*a* of the cover, and thereby the marginal portion 3*a* of the cover is held in sandwich relation between the pawl 4 and the flange portion 2*a*. The cup 2 and the cover 3 are then maintained in their closed state, as shown in FIG. 6(*b*). This engaging means, provided on a surface of the flange portion 2*a* on a side thereof engaging with the cover 3, enables a surface of the flange portion 2*a* on the side thereof contacting with the second sheet portion having the cut-out window portion forming a part of the postal matter, i.e., a surface of the flange portion 2*a* opposite a surface of the flange portion 2*a* on the side thereof engaging with the cover 3 to be kept flat. The number of engaging means may be determined on an as needed basis, as in the case of the protruding postal matter case shown in FIG. 1(*a*).

Figure 7A:
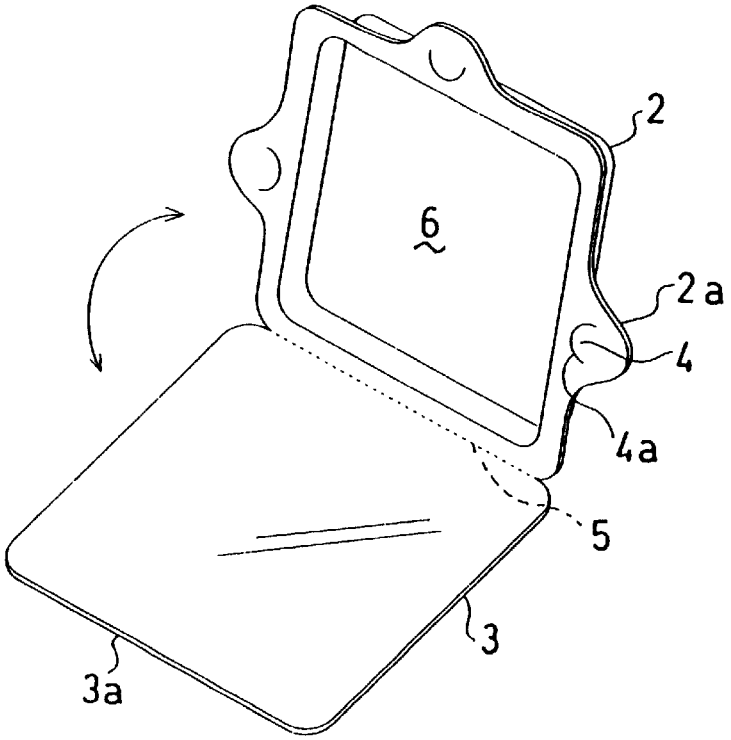
Figure 7B:
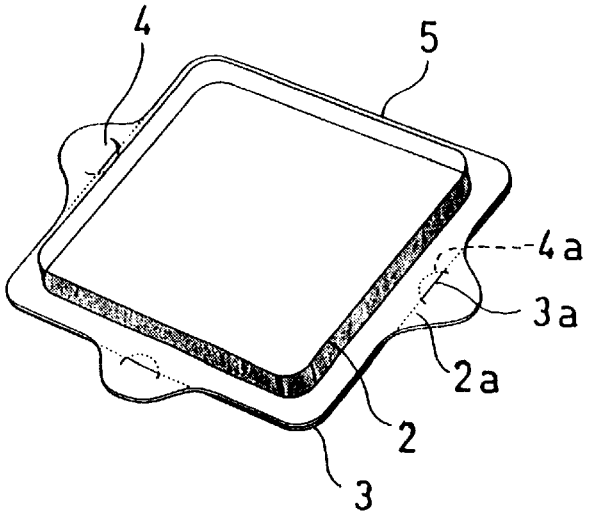

This protruding postal matter case is made using the same material and color including clear colorlessness as those of the protruding postal matter case shown in FIG. 1(*a*). The cup may be formed in various forms, as in the case of the protruding postal matter case shown in FIG. 1(*a*). In the protruding postal matter case shown in FIG. 7(*a*), the cap 2 is formed into a square.

Figure 8:
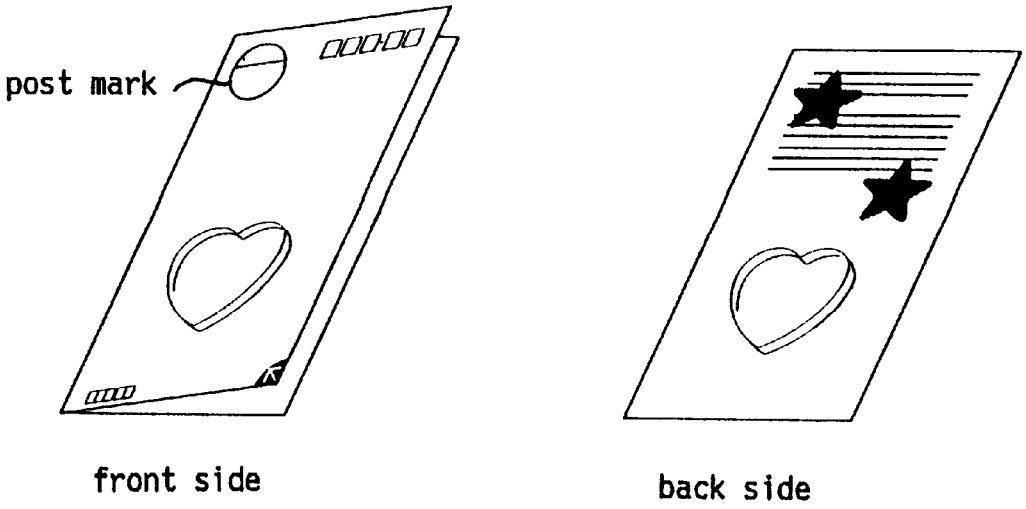
FIG. 8 is a showing of another protruding postal matter case of the present invention fitted to a postal matter.

Further, the protruding postal matter case may be modified such that the cover also has an inner space therein and a flange portion therearound correspondingly in shape to those of the cup and also the first and second sheet portions have the cut-out window portions, respectively, so that the case projects through the opposite sides of the postal matter, as shown in FIG. 8.

Figure 9A:
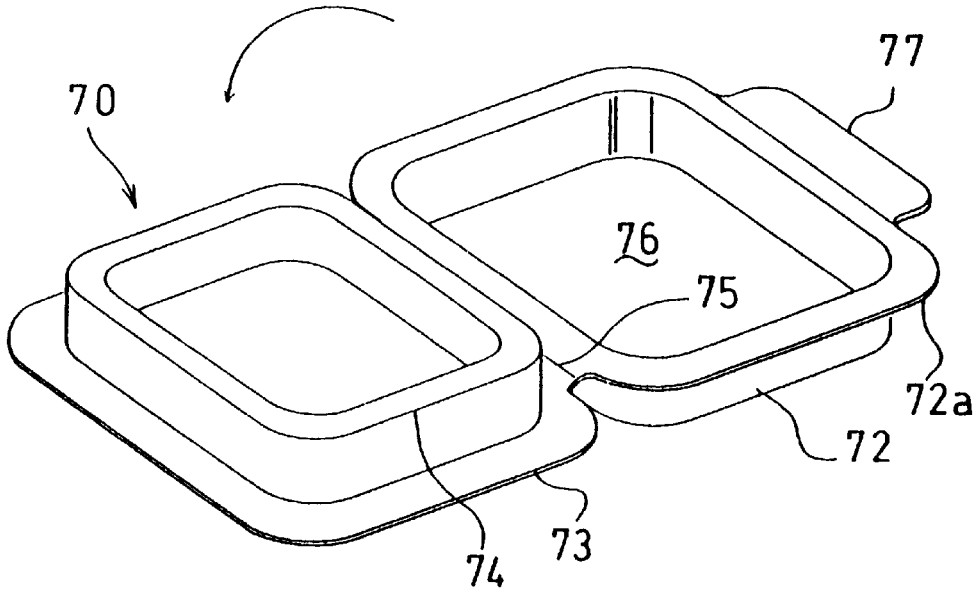
Figure 9B:
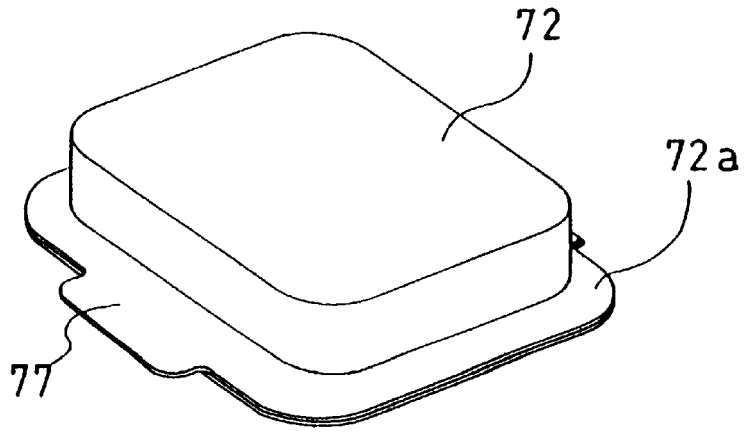

Shown in FIG. 9(*a*) is a double-folded protruding postal matter case in which a cover 73 and a cup 72 are integrally formed with each other.

The protruding postal matter case 70 comprises a quadrangular prism-shaped cup 72 having a space 76 therein, a flange portion 72*a* therearound and a grip 77; a plate-like cover 73 for closing the inner space 6 of the cup 72; and an engaging means 74, provided on the plate-like cover 73, for bringing the cover 73 and the cup 72 into engagement with each other.

The cup 72, cover 73 and engaging means 74 of the double-folded protruding postal matter case 70 are usually formed in one piece by a press by which the blanking and the intrusion process are done simultaneously, in consideration of productivity and cost efficiency. At a boundary between the cover 73 and the flange portion 72*a*, a thin-wall plate or a crease 75 of a broken line formed by a cutting edge is formed. The protruding postal matter case 70 thus formed has such a configuration that the cover 73 and the flange portion 72*a* can automatically be laid over each other with reference to the creation 75 via resilience of plastics.

The engaging means 74 is a wall member which projects from the cover 73 toward the cup 72 along the side surface of the quadrangular prism-shaped cup 72 so that it can be inserted into the inner space 76 in the cup 72. This wall member 74 can be formed at the same time as the press molding.

This protruding postal matter case 70 is made using the same material and color including clear colorlessness as those of the protruding postal matter case shown in FIG. 1(*a*). In the protruding postal matter case 70 as well, the cup 72 may be formed in various forms, as in the case of the protruding postal matter case shown in FIG. 1(*a*).

Next, the steps of containing a small article will be described.

In FIG. 9(*a*), the small article is put in the space surrounded by the wall member 74. After completion of the putting of the small article in the inner space, the grip 77 of the cup 72 is held with one's fingers, and the cup 72 is folded along the crease 75 in the direction of the arrow to close the case. Then, the cup 72 is brought into engagement with the cover 73, as shown in FIG. 9(*b*) . The wall member of the engaging member 74 prevents the small article contained in the inner space of the cup 72 from coming out easily.

Figure 10A:
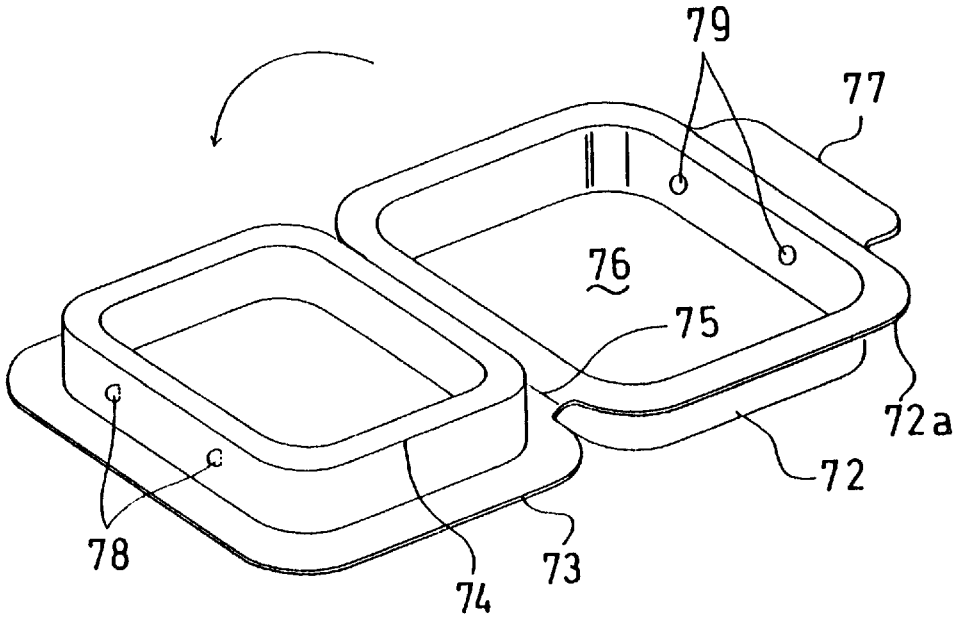
Figure 10B:
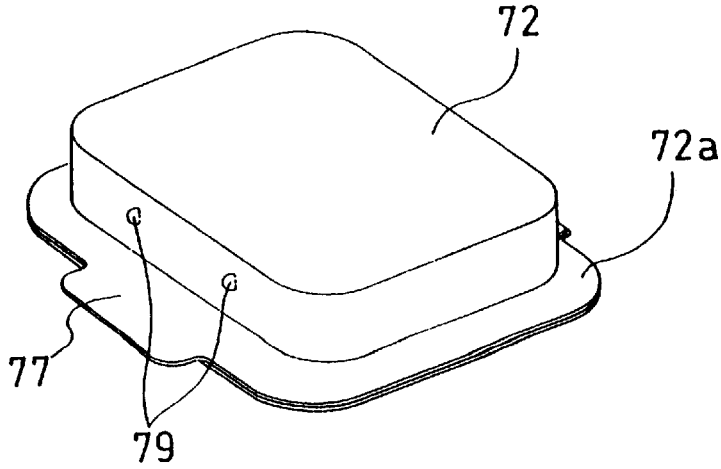

The protruding postal matter cases shown in FIGS. 10(*a*) to 11 are variants of the protruding postal matter case 70 shown in FIG. 9(*a*), in which in addition to the wall member 74 of the engaging means, engaging portions are provided between a side surface of the hexahedron-shaped cup 72 and the wall member 74, to ensure the engagement of the cover 73 and the cup 72. The engaging portions are located opposite the crease 75.

The engaging portions shown in FIG. 10(*a*) are composed of two small circular recesses 79 provided in a side surface of the quadrangular prism-shaped cup 72 on the inner space side; and two small circular convex portions 78 projecting from the wall member 74 at positions thereof being engageable with the circular recesses 79. When the cup 72 and the cover 73 are closed, the convex portions 78 of the wall member 74 are fittingly engaged in the recesses 79 of the cup 72.

Figure 11:
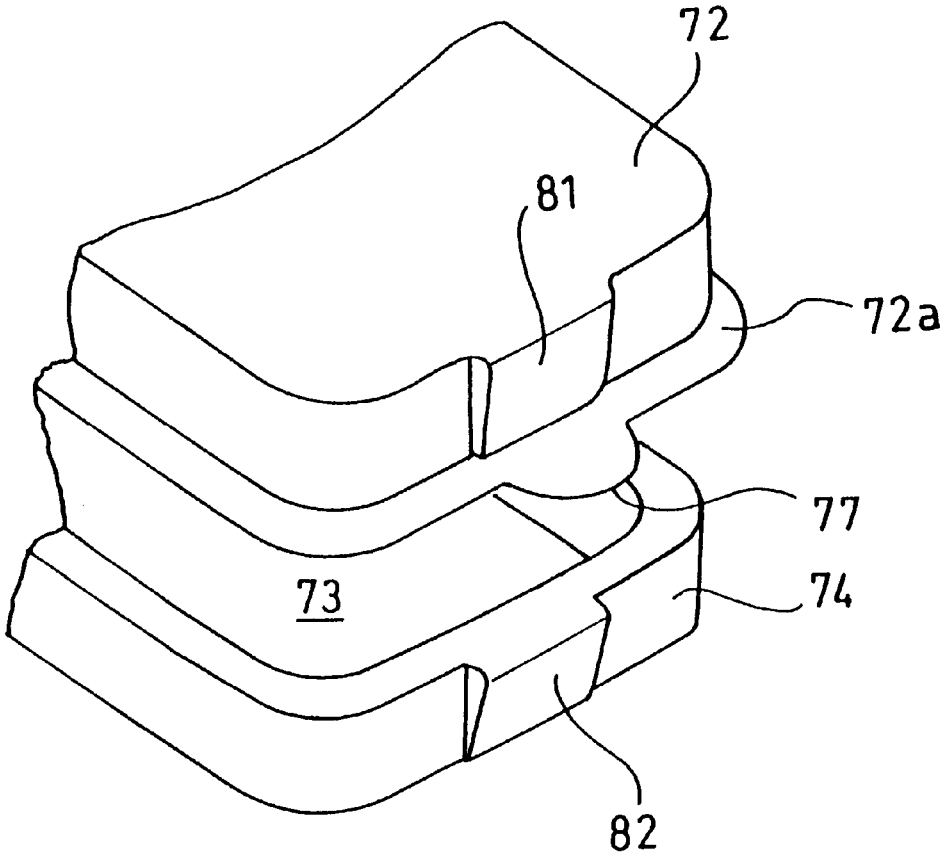
FIG. 11 is a perspective view of an example of an engaging portion of a second protruding postal matter case of the present invention.

The engaging portions shown in FIG. 11 are composed of a tapered recess 81 provided in a side surface of the quadrangular prism-shaped cup 72 on the inner space side thereof; and a tapered convex portion 82 projecting from the wall member 74 at a position thereof being engageable with the tapered recess 81. The tapers of the engaging portions are so formed as to progressly increase in thickness toward the cup 72 from the cover 73. When the cup 72 and the cover 73 are closed, the tapered convex portion 82 of the wall member 74 is fittingly engaged in the tapered recess 81 of the cup 72.

Figure 12A:
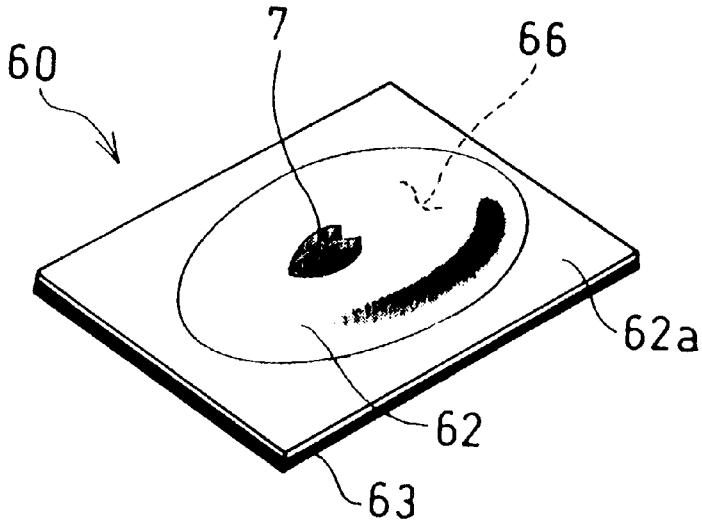
FIG. 12(*a*) is a perspective view of the second protruding postal matter case of the present invention which is in the closed state.
Figure 12B:
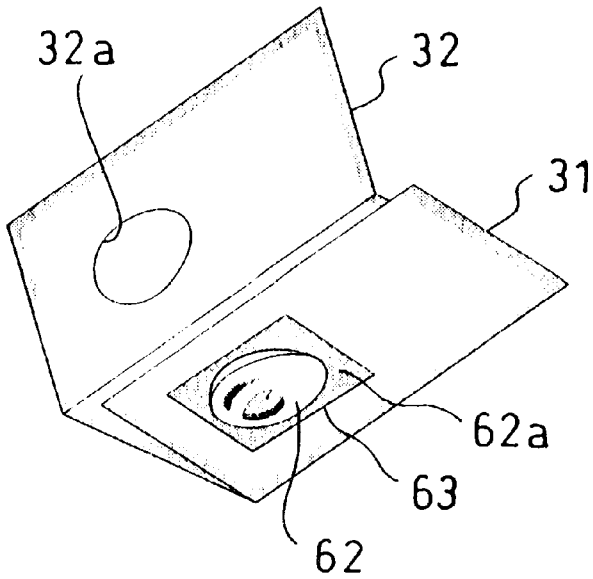

Referring now to FIGS. 12(*a*) to 14(*b*), description will be given on the second embodied protruding postal matter cases of the present invention.

Shown in FIGS. 12(*a*) to 14(*b*) are protruding postal matter cases 60 adapted to be most suitable for mass production thereof. As shown in FIG. 12(*a*), the protruding postal matter case 60 comprises a cup 62 of an egg-like curved surface having a space 66 therein and a flange portion 62*a* therearound; a cover 63 for closing the inner space 66 of the cup 62; adhesion means for allowing the cover 63 and the flange portion 62*a* of the cup to adhere to each other; and fixing means, not shown, provided on the cover 63, for fixing the cover 63 to the first sheet portion forming a part of postal matter. As shown in FIG. 12(*b*), the cover 63 is stuck to the first sheet portion 31 forming a part of the postal matter, and the flange portion 62*a* of the cup and the cover 63 are sandwiched between the first sheet portion 31 and the second sheet portion 32, so that the cup 62 is projected from a cut-out portion 32*a* of the postal matter.

This protruding postal matter case 62 is made using the same material and color including clear colorlessness as those of the protruding postal matter case shown in FIG. 1(*a*). In the protruding postal matter case 60 also, the cup 62 may take a variety of forms, without being limited to the egg-like curved surface, as in the case of the protruding postal matter case as shown in FIG. 1(*a*).

The cover 63, sandwiched between the first sheet portion 31 and the second sheet portion 32, is preferably in the form of a film. The materials which may be used include resins such as polyethylene, metallic foils such as aluminum foil, and paper.

The adhesion means which may be used include varnish and synthetic resins. The varnish, when coated on the film-like cover 63, enables the cover 63 and the flange portion 62*a* of the cup to adhere to each other via thermocompression bonding.

When using the synthetic resins, polyolefin resin is extruded and laminated to the cover 63 to form a peel ply thereon, while on the other hand, the same polyolefin resin is coated on the flange portion 62*a* of the cup to form a peel ply thereon. Thereafter, the both formed peel plies are fused by thermocompression bonding, so that the flange portion 62*a* of the cup and the cover 63 are adhesive bonded to each other with low adhesive power. This adhesion means enables the inner space of the cup to be closed by the cover 63. Thus, the second protruding postal matter case of the present invention is suitable for containing therein powders and liquids.

The fixing means which may be used include the double-coated tape, the glue, the varnish and the synthetic resin, as in the case of the above. When the synthetic resin is used as the fixing means, after the protruding postal matter case is peeled off from the first sheet portion, no tackiness remains on the protruding postal matter case and the first sheet portion. Accordingly, after the peeling, the protruding postal matter case and the first sheet portion can be handled with ease.

Figure 13A:
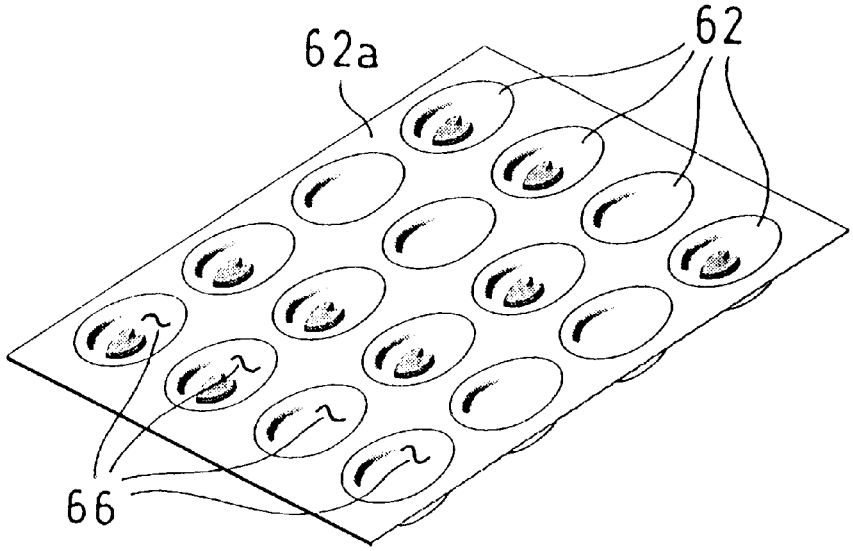
FIG. 13(*a*), FIG. 13(*b*), FIG. 14(*a*) and FIG. 14(*b*) are showings of production processes of the second protruding postal matter cases.
Figure 13B:
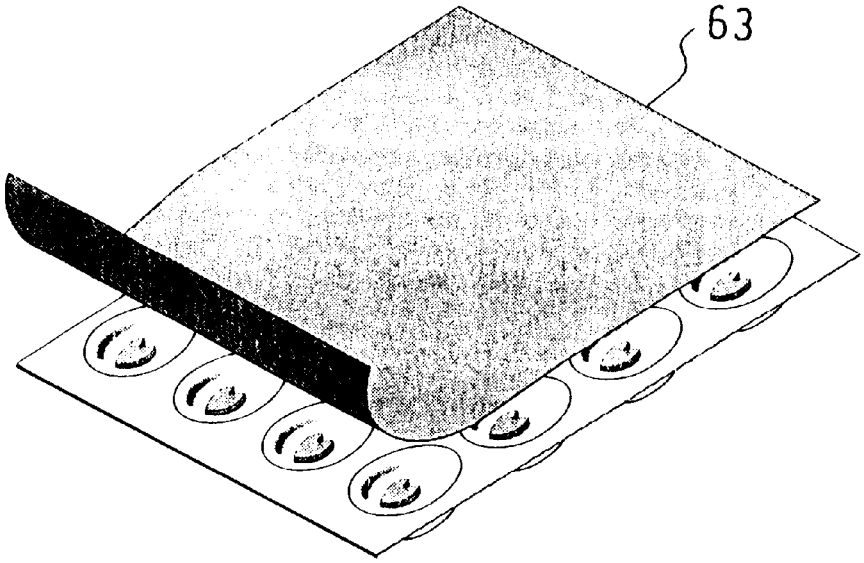

Next, with reference to FIGS. 13(*a*) to 14(*b*), the production process of the protruding postal matter case 60 will be described. In FIG. 13(*a*), a plurality of cups 62 of egg-like curved surfaces are formed in a sheet of plastic sheet so that they can have the inner spaces 66 therein and the flange portions 62*a* therearound. Polyethylene is coated on surfaces of the flange portions 62*a* on the side thereof adhering to the cover 63. In FIG. 13(*b*), the cover 63 is stuck on the flange portions 62*a* of the cups by the thermocompression bonding, with its surface laminating thereon a polyethylene layer conforming to the flange portions 62*a*, so as to close the inner spaces of the plurality of cups 62.

Figure 14A:
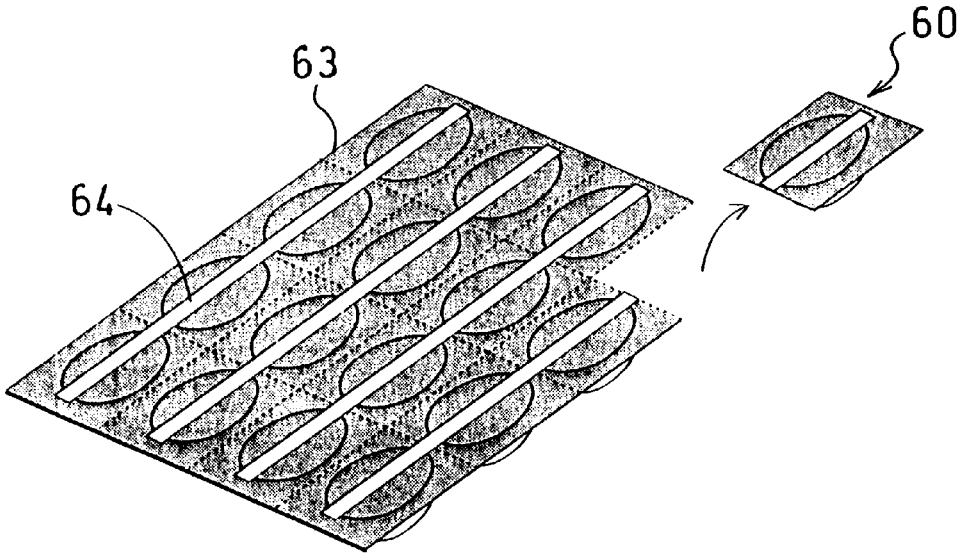
Figure 14B:
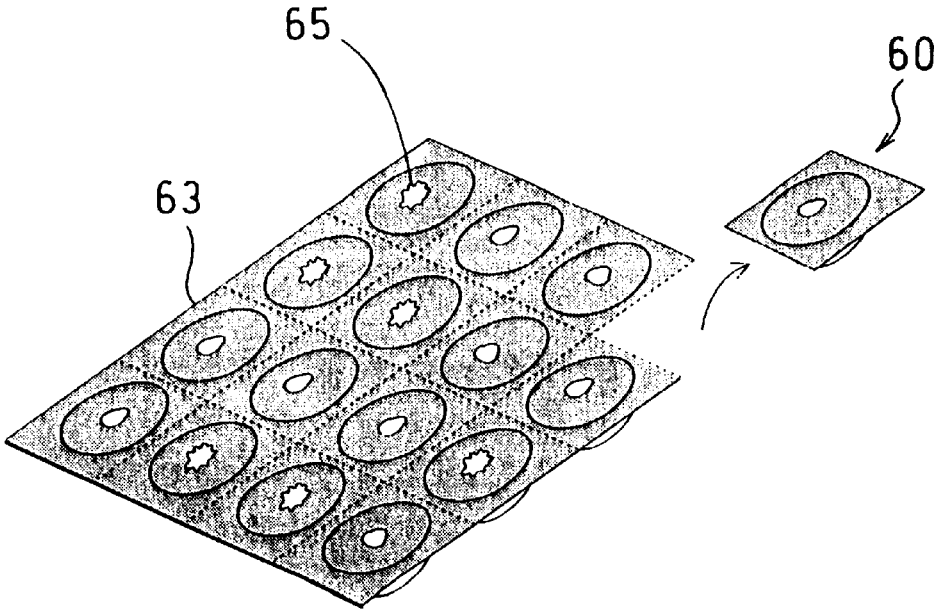

Then, as shown in FIGS. 14(*a*) or 14(*b*), the cups 62 are each provided with the fixing means 64 or 65 for fixing the cover 63 to the first sheet portion forming a part of the postal matter. In FIG. 14(*a*), the fixing means 64 is the double-coated tape, and in FIG. 14(*b*), the fixing means 65 is the glue. Finally, the respective cups 62 are cut and separated into the protruding postal matter cases 60. Then, the protruding postal matter cases 60 thus produced are each stuck on the first sheet portion 31 forming a part of the postal matter, as shown in FIG. 12(*b*).

The fixing means for fixing the protruding postal matter case to the sheet portion forming a part of the postal matter, which in the embodiment illustrated in FIGS. 13(*a*) to 14(*b*) is arranged on the cover 63, may be arranged on a portion of the flange portion 62*a* of the cup so as to be fixed to the second sheet portion having the cut-out window portion. In addition, in the state of the cup protruding from the cut-out window portion of the second sheet, the protruding postal matter case may be fixed with the tape extending from the cover 63 side across the second sheet, so as to fix the protruding postal matter case to the second sheet portion. This prevents a different postal matter from being inserted in between the second sheet portion and the flange portion 62*a*.

Figure 15:
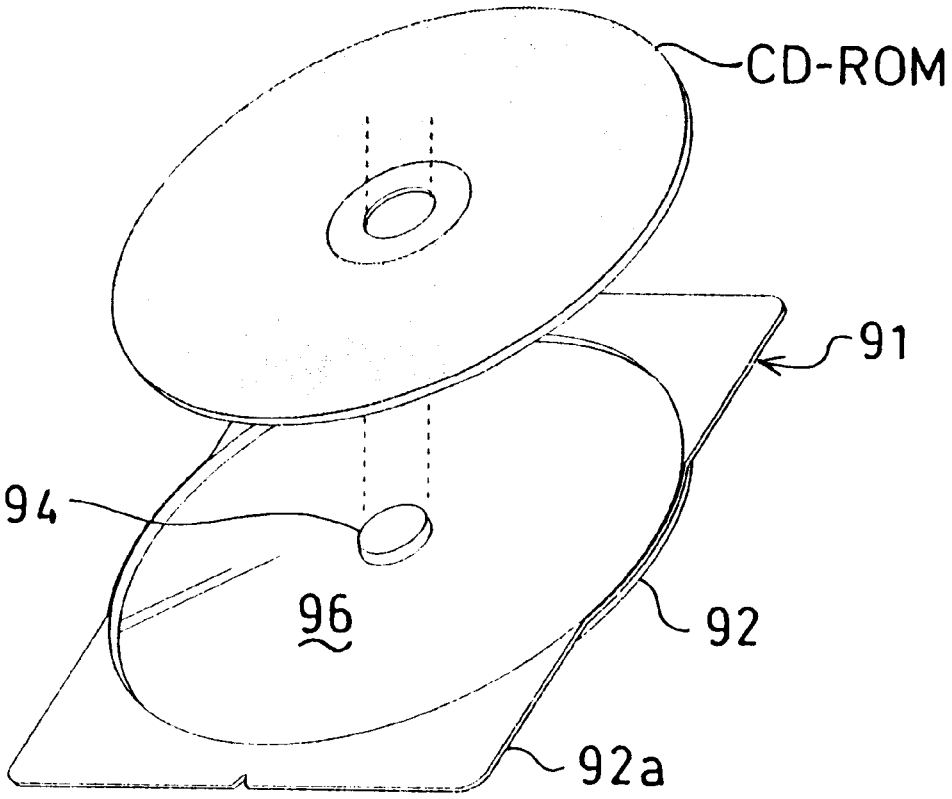
FIG. 15 is a perspective view of a third protruding postal matter case of the present invention.
Figure 16B:
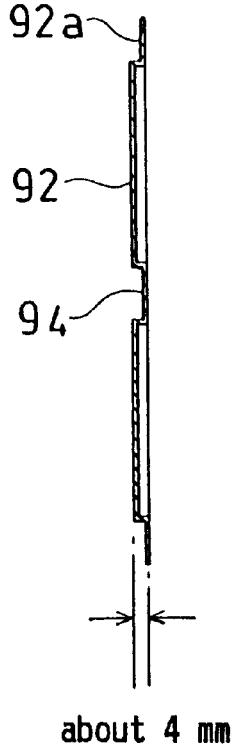
FIG. 16(*a*) is a top view of the third protruding postal matter case of the present invention.
Figure 16A:
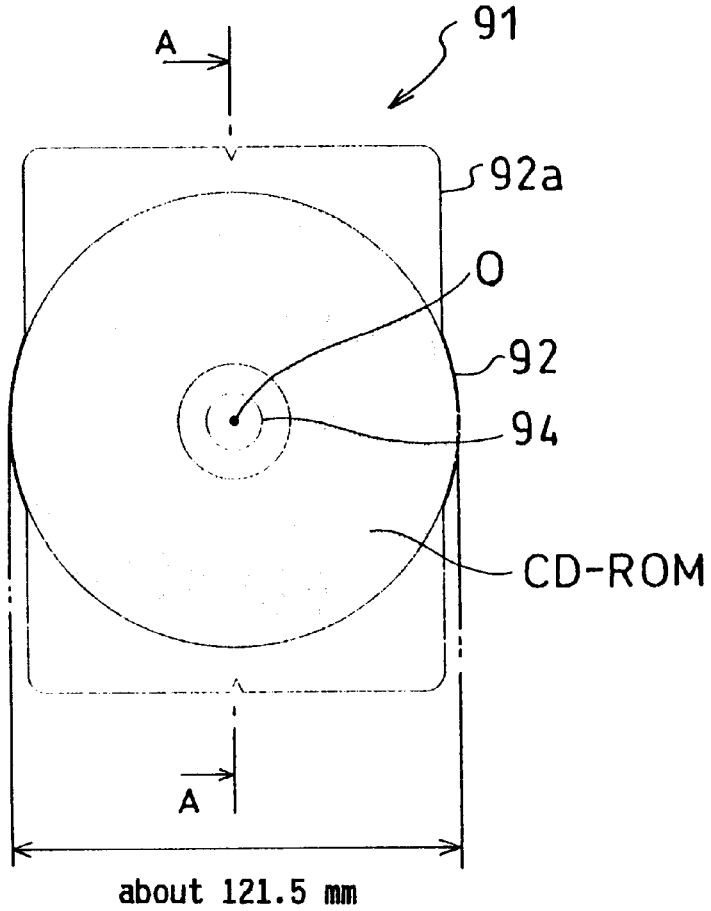

Next, with reference to FIGS. 15 to 16(*b*), the third protruding postal matter case of the present invention will be described. The protruding postal matter case shown in FIGS. 15 to 16(*b*) is a protruding postal matter case 91 suitable for containing a disc-like article, such as a CD-ROM, having a through bore at a center thereof. FIG. 15 is a perspective view of the protruding postal matter case 91; FIG. 16(*a*) is a top view of the same 91; and FIG. 16(*b*) is a sectional view taken along the line A—A of FIG. 16(*a*).

The protruding postal matter case 91 includes a disc-shaped cup 92 having a disc-like inner space 96 and a flange portion 92(*a*) therearound; and a cylindrical projection 94 located at a center of the disc-shaped cup 92 and projecting to the inner space 96 of the disc-shaped cup, as shown in FIG. 15. This protruding postal matter case 91 is also made using the same material and color including clear colorlessness as those of the protruding postal matter case shown in FIG. 1(*a*).

The disc-like inner space 96 has a maximum diameter of about 121.5 mm and a depth of about 4 mm so that a disc-like article (e.g. a CD-ROM, an optical disc, a magnetic disc, a DVD, a music CD and the like) of a diameter of 120 mm and a thickness of 1.5 mm can be received in it. The flange portion 92*a* has such a width as to be readily accommodated in a standard-size mail of elongated size No. 3 and extends vertically as viewed in the drawing. The flange portion has a V-shaped notch, located on an extension of the center 0 of the disc-like inner space 96, for positioning the protruding postal matter case 91 when fixed to the postal matter. The cylindrical projection 94 has a height equal to a depth of the disc-like inner space 96. The cylindrical projection 94 has a diameter substantially equal to the through bore at the center of the disc-like article so that when the cylindrical projection 94 is inserted in the through bore at the center of the disc-like article, the disc-like article can be prevented from easily disengaging from the cylindrical projection.

Next, the state of disc-like article being received in the protruding postal matter case 91 will be described. As shown in FIG. 15, the center through bore of the disc-like article is fitted to the cylindrical projection 94, with a side thereof facing the inner space 96 of the disc-shaped cup, and then is inserted deep in the disc-like inner space 96 to be received in it. Then, the cylindrical projection 94 having a diameter substantially equal to that of the through bore of the disc-like article at the center thereof prevents the disc-like article from easily disengaging from the disc-like inner space 96. At this time, the other side of the disc-like article is avoided projecting from the disc-like inner space 96, because the depth of the disc-like inner space 96 and the height of the cylindrical projection 94 are equally of about 4 mm and are adequately larger than the thickness of the disc-like article. Accordingly, the other side of the disc-like article is prevented from being scratched in the process of fitting the protruding postal matter case 91 to the postal matter.

Next, various forms of the postal matters to which the protruding postal matter cases described above are to be fitted will be described. The first to third protruding postal matter cases of the present invention described above can be fitted to any type postal patter described later.

Figure 17A:
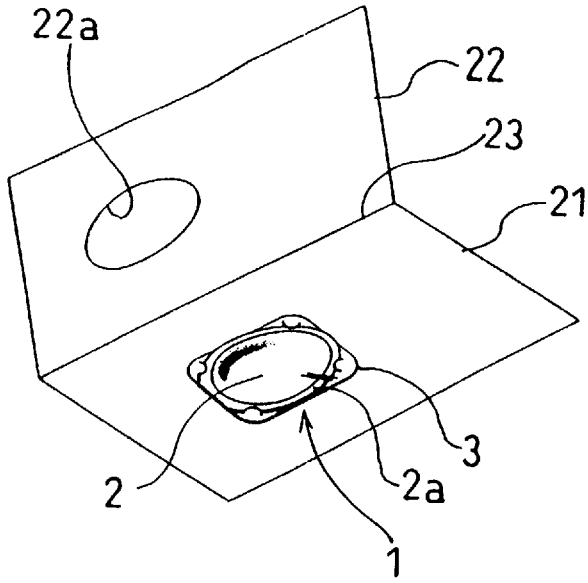
FIGS. 17(*a*), 17(*b*) and 17(*c*) are illustrations of the way of fitting the protruding postal matter case of the present invention to a double folded postal matter.
Figure 17B:
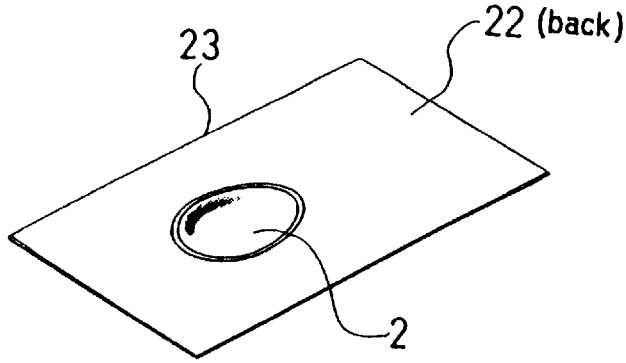
Figure 17C:
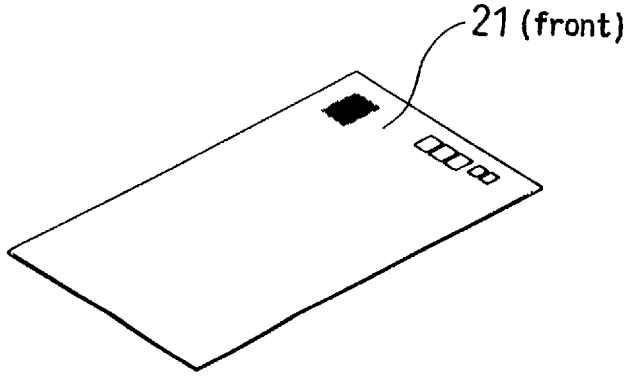

With reference to FIGS. 17(*a*) to 26(*c*), the way of fitting the protruding postal cases of the present invention to the postal matters will be described. First, with reference to FIGS. 17(*a*) to 19(*c*), the fitting way will be described taking the protruding postal matter case 1 shown in FIGS. 1(*a*) to 3(*d*) as an example.

Shown in FIG. 17(*a*) is a postal matter into which a rectangular sheet is double folded. The sheet for forming the postal mater has a first sheet portion 21, a second sheet 22 and a crease 23 between the first and second sheet portions 21,22. The second sheet portion 22 has a cut-out window portion 22*a*.

The protruding postal matter case 1 combined with the small article 7 is glued on the first sheet portion 21 at a position thereof to be laid over the cut-out window portion 22*a*, as shown in FIG. 17(*a*). Various kinds of glues are available, and the fixing means formed by any of these various kinds of glues is cheaper than the double-coated tapes and also more convenient for automation and thus suitable for the mass production.

The second sheet portion 22 is double folded along the crease 23 to be laid over the first sheet portion 21 and thereafter is closed in the form of a postal matter. Then, the flange portion 2*a* of the cup and the cover 3 are sandwiched between the first sheet portion 21 and the second sheet portion 22, so that a portion of the cup 2 having the inner space protrudes from the cut-out window portion 22*a*, as shown in FIG. 17(*b*).

Closing means which may be used for closing the first and second sheet portions 21, 22 in the form of the postal matter include various kinds of glues, staplers, double-coated tapes and resins. The closing means may be provided around only a marginal portion of a sheet forming the postal matter, but should preferably be provided around a marginal portion of the cut-out window portion as well, for close adherence to the flange portion. This should be done for the purpose of preventing a different postal matter being inserted in between the second sheet portion and the flange portion.

Various kinds of glues and resins are suitable for the mass production by automation in that they can be pre-coated around a marginal portion of a sheet forming a postal matter or over an entire surface of the inside of the postal matter so that the sheet can be closed by thermocompression bonding, press-contacting and the like. The closing means formed by staplers or double-coated tapes requires a manual working and the double-coated tapes, in particular, cost more, so various kinds of glues and resins are actually more suitable for the mass production by the automation than the staplers or double-coated tapes.

Figure 18A:
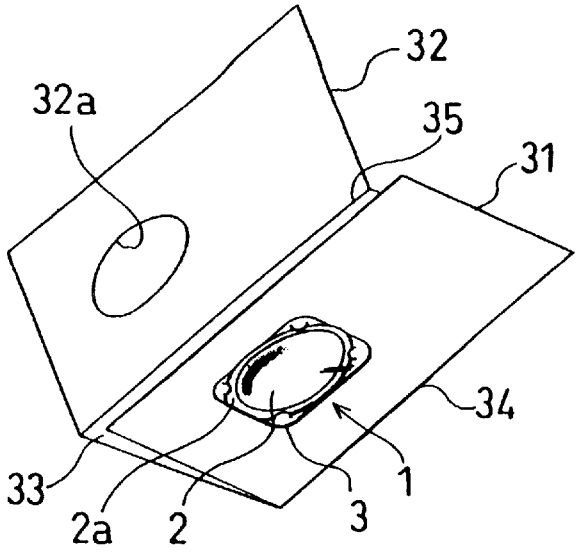
FIGS. 18(*a*), 18(*b*) and 18(*c*) are illustrations of the way of fitting the protruding postal matter case of the present invention to a three folded postal matter.
Figure 18B:
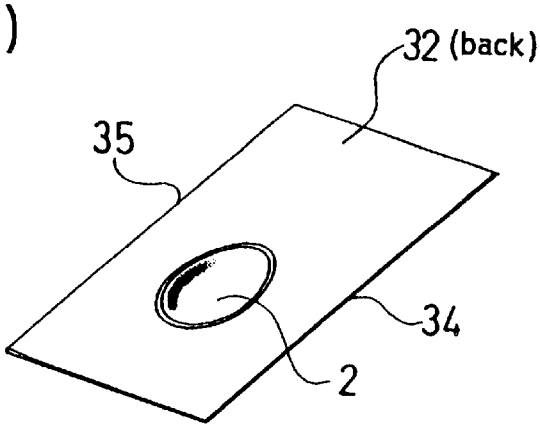
Figure 18C:
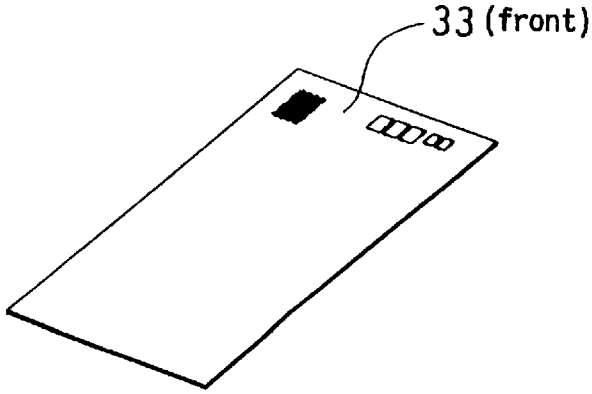

FIG. 18(*a*) shows a postal matter formed by a rectangular sheet being folded into three. The sheet for forming the postal matter has a first sheet portion 31, a second sheet portion 32, an intermediate sheet portion 33 and creases 34, 35. The second sheet portion 32 is provided with a cut-out window portion 32*a*. First, the first sheet portion 31 is folded along the crease 34 and laid over the intermediate sheet portion 33, as shown in FIG. 18(*a*). The protruding postal matter case 1 combined with the small article 7 in accordance with the steps discussed above is glued on the first sheet portion 31 at a position thereof to be laid over the cut-out window portion 32*a*. Various kinds of glues are available, and the adhesion means formed by any of the variety of glues is cheaper than the double-coated tapes and more convenient for automation and thus suitable for the mass production.

Then, the second sheet portion 32 is folded along the crease 35 and laid over the first sheet portion 31 to be closed in the form of a three-folded postal matter. As a result, as shown in FIG. 18(*b*), the flange portion 2*a* of the cup and the cover 3 are sandwiched between the first sheet portion 31 and the second sheet portion 32, so that a portion of the cup 2 having the inner space is put into the state of protruding from the cut-out window portion 32*a*.

The closing means which may be used for closing the first and second sheet portions 21, 22 in the form of the postal matter include various kinds of glues, staplers, double-coated tapes and resins, as in the case of the above. The closing means is provided around only the marginal portion of a sheet forming the postal matter. Thus, a pocket is formed between the first sheet portion 31 and the intermediate sheet portion 33, so that paper 37, such as a letter paper and a photograph, is inserted in the pocket to be a sealed letter, as shown in FIGS. 19(*a*), 19(*b*) and 19(*c*).

Figure 19A:
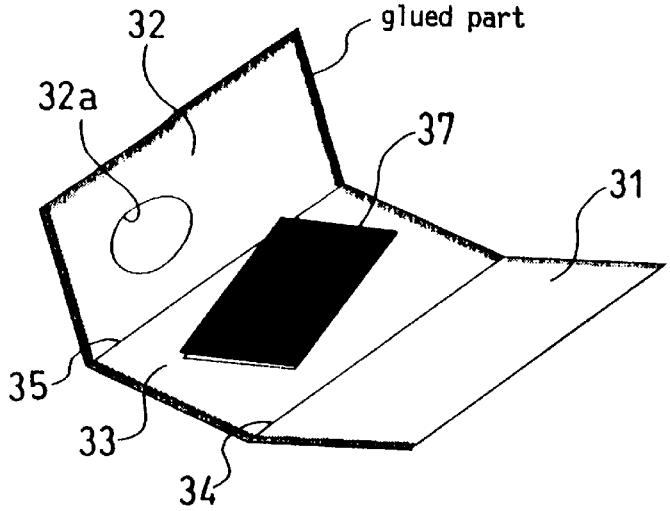
FIGS. 19(*a*), 19(*b*) and 19(*c*) are illustrations of the way of inserting papers in the postal matter fitting thereto the protruding postal matter case of the present invention in sealed relation.
Figure 19B:
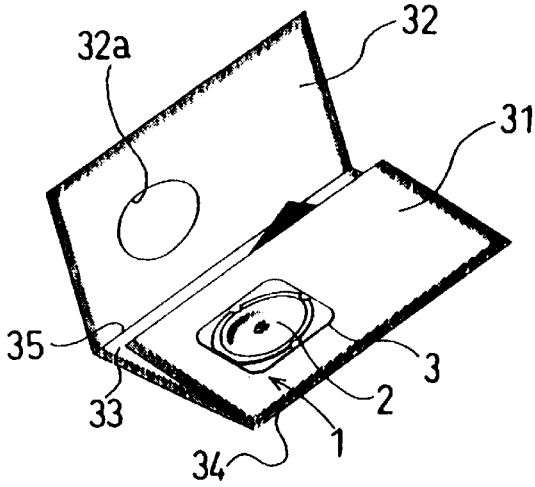
Figure 19C:
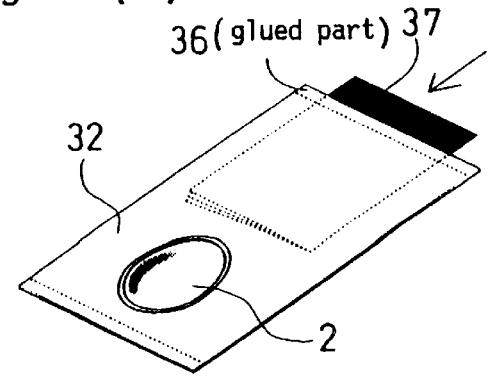

FIGS. 19(*a*) and 19(*b*) illustrate the paper 37, such as the letter paper is inserted in the pocket in the process of the folding work of forming a postal matter from a sheet. In FIG. 19(*c*), the paper 37 such as a letter paper is inserted in the pocket from a part 36 of one end of the letter sealed after completion of the folding work. Then, the glued part of the postal matter is closed by thermocompression bonding. In this embodiment also, a portion of the second sheet portion around the cut-out window portion and the flange portion of the cup should preferably be in close adherence to each other, in order to prevent a different postal matter being inserted in between the second sheet portion and the flange portion.

When formed into the postal matters as shown in FIGS. 17(*a*) to 19(*c*), a rectangular sheet may be formed into more folds without limiting to the double-folded or the three-folded, depending on its longitudinal length. Thus, the number of folds of a rectangular sheet being formed into the postal matter is not limited to two or three.

Figure 20A:
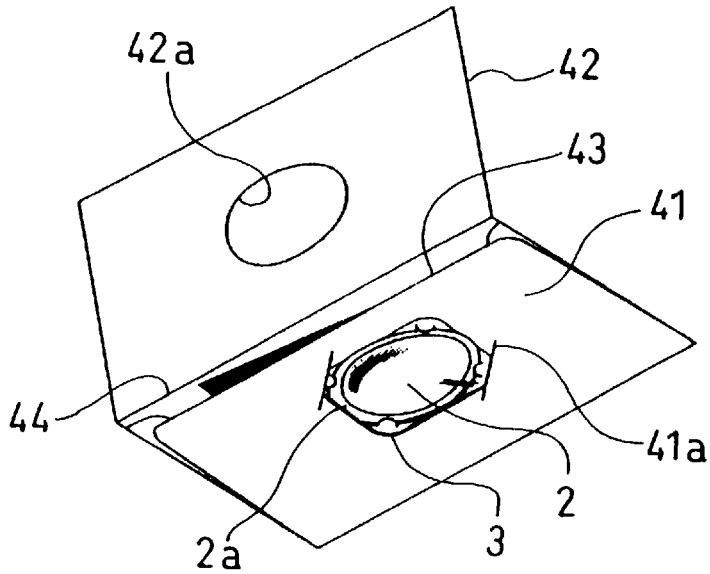
FIGS. 20(*a*), 20(*b*) and 20(*c*) are illustrations of the way of fitting the protruding postal matter case of the present invention to a postal matter in the form of an envelop.
Figure 20B:
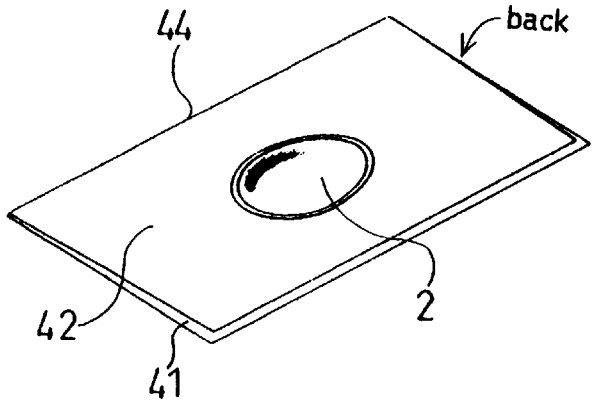
Figure 20C:
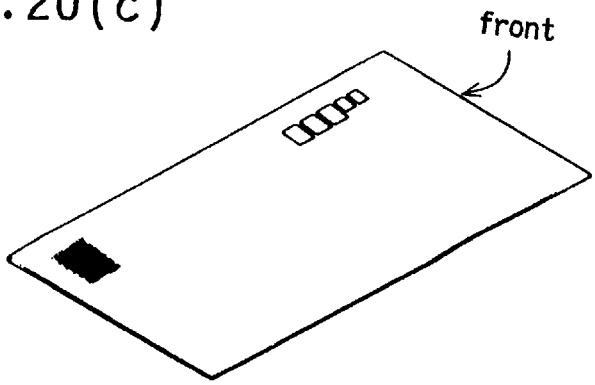

FIG. 20(*a*) illustrates an envelope in which a pocket is already formed.

This envelope has a first sheet portion 41, a second sheet pocket 42 and the pocket 43 and a crease 43. The second sheet portion 42 is provided with a cut-out window portion 42*a*. The first sheet portion 41 is provided, at two positions in the neighborhood of a larger diameter side thereof to be laid over the cut-out window portion 42*a* of the second sheet portion, with a pair of cut-out portions 41*a* which are symmetry with respect to each other.

The protruding postal matter case 1 combined with the small article 7 in accordance with the steps discussed above is fixed to the first sheet portions 41*a* by the marginal portion of the cover 3 being inserted in the cut-out portions 41*a* of the first sheet portion 41. The number and position of the cut-out portions 41*a* may be determined properly according to shapes of the cover or flange portion of the cup of the protruding postal matter case. It is noted that these fixing means of the protruding postal matter formed by the cut-out portions in the first sheet portion may be adopted in the embodiments shown in FIGS. 17(*a*) to 19(*c*) as well. In addition, gluing means including glues may be adopted in the embodiment of FIG. 20(*a*) as well.

Then, the second sheet portion 42 is folded along the crease 44 and laid over the first sheet portion 41 to be closed in the form of a postal matter. As a result, as shown in FIG. 20(*b*), the flange portion 2*a* of the cup and the cover 3 are sandwiched between the first sheet portion 41 and the second sheet portion 42, so that a portion of the cup 2 having the inner space is put into the state of protruding from the cut-out window portion 42*a*. In this embodiment also, a portion of the second sheet portion around the cut-out window portion and the flange portion of the cup should preferably be in close adherence to each other, in order to prevent a different postal matter being inserted in between the second sheet portion and the flange portion. The closing means which may be used for closing the first and second sheet portions 41, 42 in the form of the postal matter include various kinds of glues, staplers, double-coated tapes and resins, as in the case of the above.

It is to be noted here that any of the protruding postal matter cases, which in the illustrations of FIGS. 17(*a*) to 20(*c*) is fitted to the first sheet portion, may be fixed by simply bringing the flange portion of the cup into close adherence to the cut-out window portion of the second sheet portion.

The second sheet portions each having the cut-out window portion, which in FIGS. 17(*a*) to 20(*c*) are each marked as the back to which no address and postage stamp are affixed, may be marked as the front to which the address and postage stamp are to be affixed.

Also, the postal matters, which in FIGS. 17(*a*) to 20(*c*) are all originally formed from a rectangular sheet, may be formed from a sheet of different shape than rectangle. For example, the rectangular sheet may have partly extended portions around a marginal portion thereof, as shown in FIGS. 21(*a*) to 26(*c*).

Figures 21A, 21B, 21C:
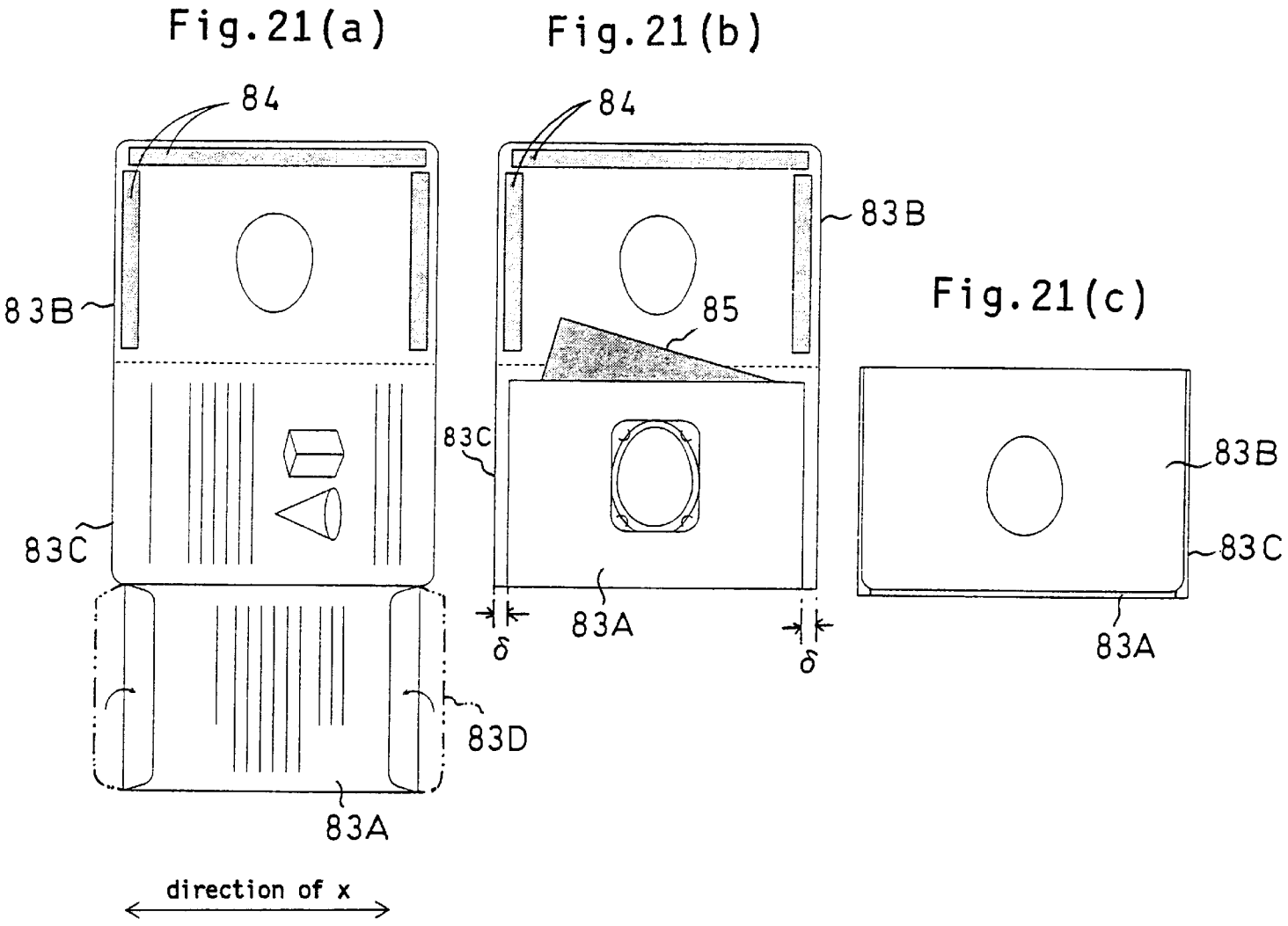
FIGS. 21(*a*), 21(*b*), 21(*c*), 22(*a*), 22(*b*), 22(*c*), 23(*a*), 23(*b*), 24, 25(*a*), 25(*b*), 26(*a*), 26(*b*) and 26(*c*) are illustrations of the fitting way of the protruding postal matter case of the present invention.

FIG. 21(*a*) shows a development of a three-folded, sealed letter type postal matter. The sheet material comprises a first sheet portion 83A, a second sheet portion 83B, an intermediate sheet portion 83C and extended sheet portions 83D provided in the first sheet portion 83A. On the first sheet portion 83A and the intermediate sheet portion 83C at portions thereof to be positioned inside when closed in the form of a sealed letter, lines or something are printed for the purpose of advertisements or for use as a letter paper. The second sheet portion 83B has the closing means 84, such as the glues or the double-coated tapes, at portions thereof, but a side thereof adjoining the intermediate sheet portion 83C. Thus, a sheet material can be formed into a sealed letter form by the following steps. First, the extended sheet portions 83D are folded to the inside in FIG. 21(*a*) such that a width of the first sheet portion 83A in the direction of X can be made smaller than a width of the intermediate sheet portion 83C in the direction of X. Then, the first sheet portion 83A is folded toward the intermediate sheet portion 83C and then the protruding postal matter case of this embodiment of the invention is fixed thereto, as shown in FIG. 21(*b*). In this step, the intermediate sheet portion 83C lies off the edge of the first sheet portion 83A by an amount of δ, because the width of the first sheet portion 83A in the direction of X is smaller than the width of the intermediate sheet portion 83C in the direction of X. At this stage, a photograph 85 or something, when contained in the sealed letter, is inserted in between the first sheet portion 83A and the intermediate sheet portion 83C. Then, the second sheet portion 83B is folded toward the first sheet portion 83A and is closed by the closing means 84 provided in the second sheet portion 83B, to form a sealed letter form, as shown in FIG. 21(*c*). At this time, the closing means 84 are laid over the portions of the intermediate sheet portion 83C extended from the first sheet portion 83A, thus enabling the sheet material to be closed in the sealed letter form.

Figures 22A, 22B, 22C:
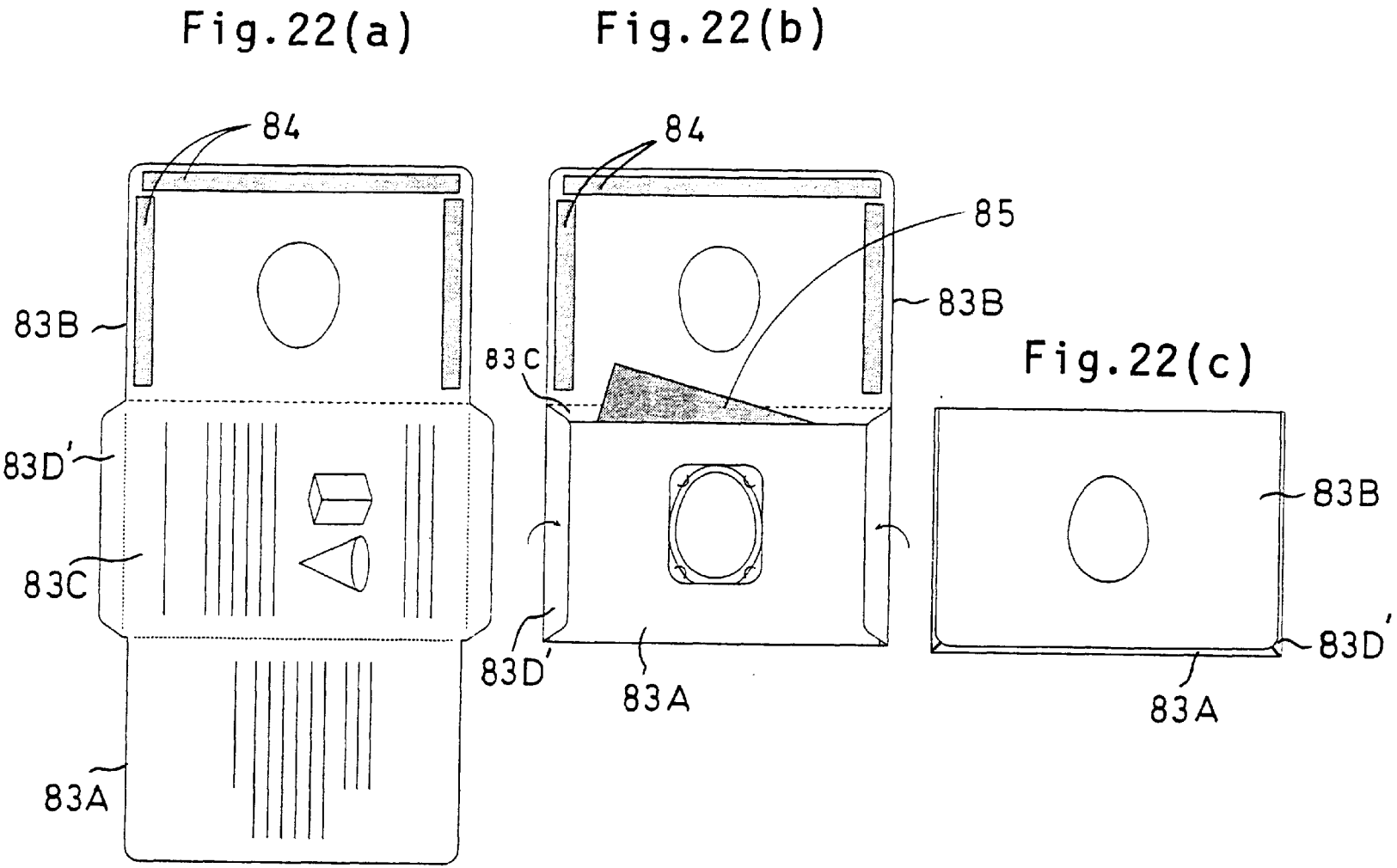

FIG. 22(*a*) shows a development of a three-folded, sealed letter type postal matter, which is similar to that of FIG. 21(*a*) but different therefrom in that extended portions 83D' are arranged in the intermediate sheet portion 83C. The sheet material can be formed into a sealed letter form by the following steps. First, the first sheet portion 83A is folded toward the intermediate sheet portion 83C in FIG. 22(*a*). Subsequently, the extended portions 83D' are folded to the inside to be aligned with the edges of the first sheet portion 83A and then the protruding postal matter case of this embodiment of the invention is fixed, as shown in FIG. 22(*b*). At this stage, a photograph 85 or something, when contained in the sealed letter, is inserted in between the first sheet portion 83A and the intermediate sheet portion 83C. Then, the second sheet portion 83B is folded toward the first sheet portion 83A to be laid over it and is closed by the closing means 84 provided in the second sheet portion 83B, to form a sealed letter form, as shown in FIG. 22(*c*). At this time, the closing means 84 are laid over the extended portions 83D', thereby enabling the sheet material to be closed in the sealed letter form.

Figure 23A:
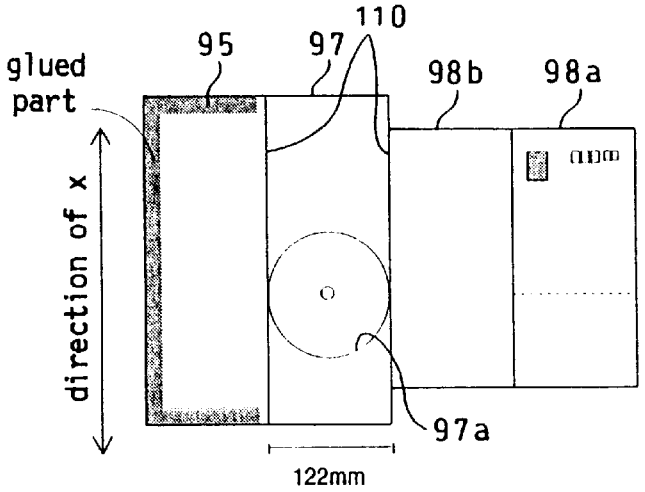
Figure 23B:
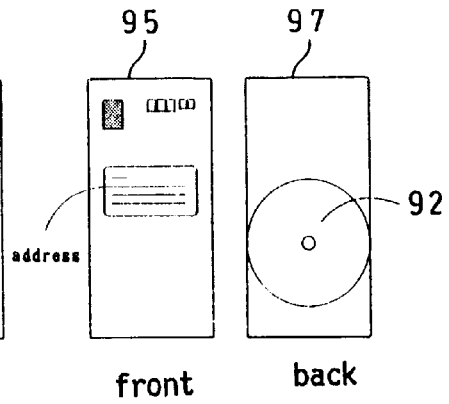

Next, description will be given, taking the protruding postal matter case 91 shown in FIGS. 15 to 16(*b*) as an example. The fitting of the protruding postal matter case 91 receiving therein a disc-like article to a postal matter will be described, with reference to FIGS. 23(*a*) and 23(*b*). In FIG. 23(*a*), the postal matter comprises a first sheet portion 95 forming a part of the postal matter; a second sheet portion 97 having a cut-out window portion 97*a* and laid over the first sheet portion 95 to be closed in the form of the postal matter; and intermediate sheet portions 98*a*, 98*b*. The intermediate sheet portions 98*a*, 98*b*, which are to be folded in between the first sheet portion 95 and the second sheet portion 97, has the widths in the direction of X shorter than the widths of the first and second sheet portions in the direction of X.

The disc-shaped cup 92 of the protruding postal matter case 91 receiving therein the disc-like article is fitted in the cut-out window portion 97*a* of the second sheet portion 97. With the V-shaped notch of the flange portion 92*a* aligned with a positioning dotted line, not shown, the case is fixed to the second sheet portion 97. Then, the intermediate sheet portions 98*a*, 98*b* are folded to the inside in order and laid over the second sheet portion 97. Then, the first sheet portion 95 is laid over the second sheet portion 97 and closed in the form of a postal matter by the glue or the double-coated tape. Then, a postal matter is produced in which the flange portion 92*a* of the disc-shaped cup is sandwiched between the first sheet portion 95 and the second sheet portion 97 and the disc-shaped cup 92 projects from the cut-out window portion 97*a* of the postal matter, as shown in FIG. 23(*b*).

The intermediate sheet portions 98*a*, 98*b* and the first sheet portion 95 cover a surface of the disc-like article on an opening side of the protruding postal matter case 91 having the disc-like inner space 96 receiving the disc-like article therein, so that when the case is delivered as a postal matter, both sides of the disc-like article are avoided being scratched. Postal matters ranging in size up to a maximum width of 122 mm and a total thickness of 10 mm are recognized as the standard-size mail, and thus the postal matter having the protruding postal matter case 91 of the present invention can be handled as the standard-size mail. In this embodiment, the second sheet portion 97 shown in FIG. 23(*a*) has a width of 122 mm which is substantially equal to a diameter (about 121.5 mm) of the protruding postal matter case 91 of the present invention. For facilitation of the folding process of the postal matter with accuracy, perforation 110 should preferably be provided at a boundary between the second sheet portion 97 and the first sheet portion 95 and a boundary between the second sheet portion 97 and the intermediate sheet portion 98*b*.

As long as the cylindrical projection has such a diameter as to fit in a given sized through bore of the disc-like article in such relation as to be resistant to disengagement therefrom and a height larger than a given thickness of the disc-like article, not only a disc-like article having a large diameter of 120 mm like a CD-ROM but also a disc-like article having a small diameter like a Mini-Disc may be used. Also, as long as the disc-like article has at the center thereof the through bore of a given size having a maximum diameter of not more than 120 mm, the disc-like article is not necessarily formed in a perfect circular form but may be formed into a different form like a shirt or a star.

Figure 24:
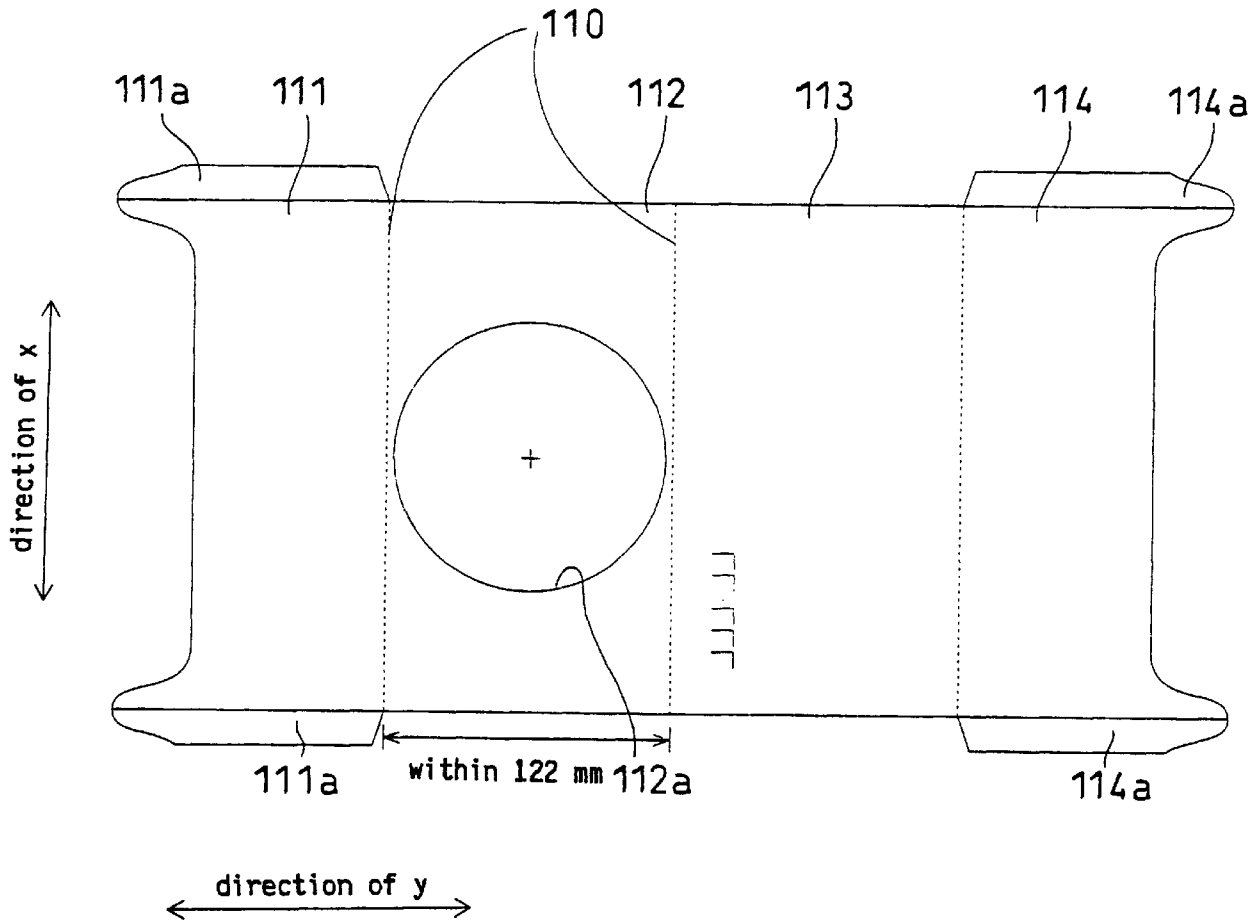
Figure 25B:
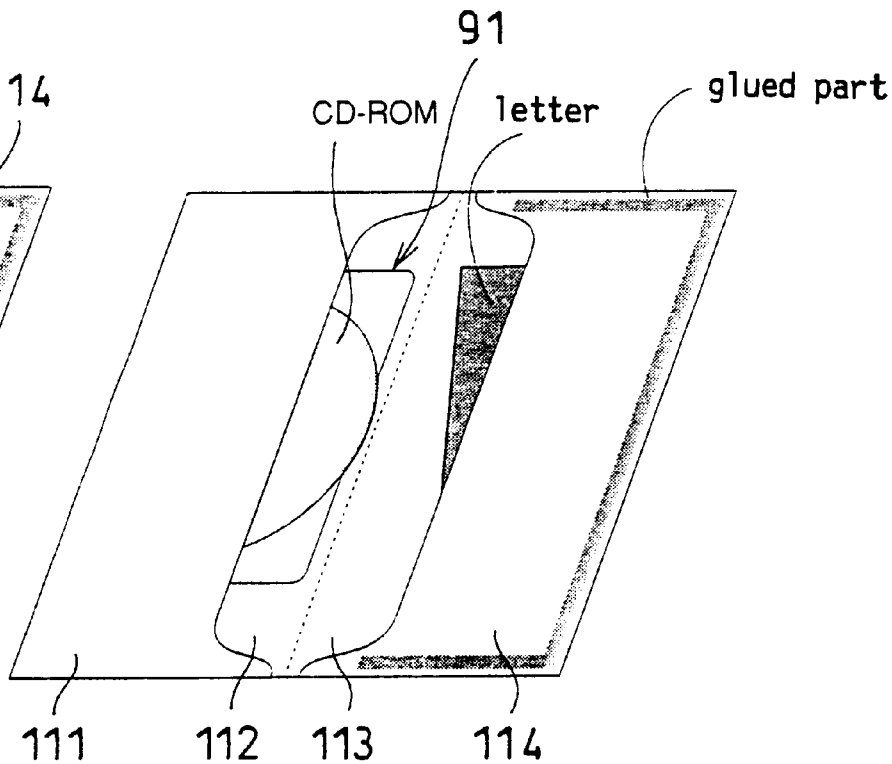
Figure 25A:
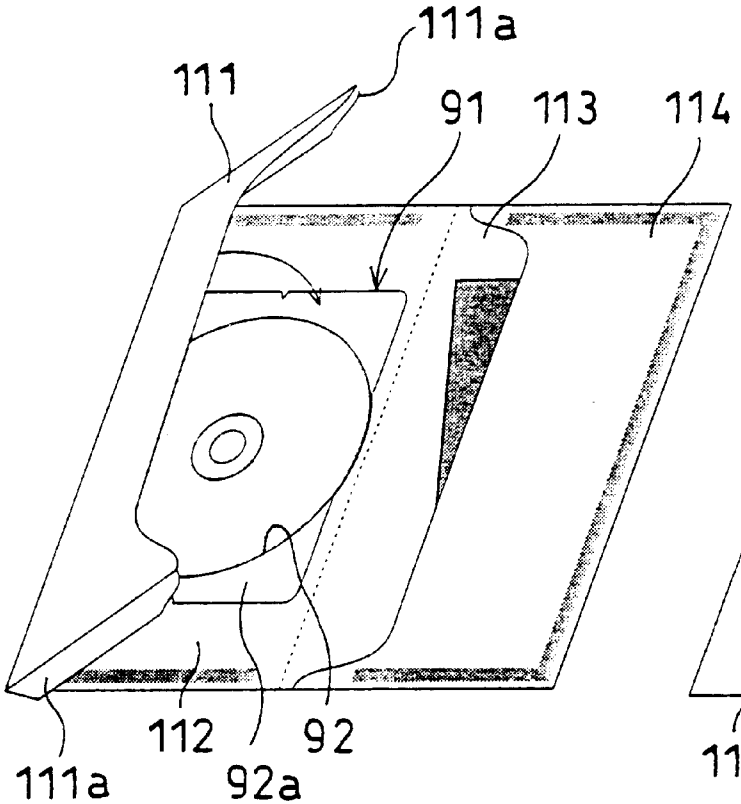

FIGS. 24 to 25(*b*) are illustrations of another embodied form of the protruding postal matter case 91 receiving therein the disc-like article fitted to the postal matter.

In FIG. 24, the postal matter comprises a first sheet portion 111 forming a part of a postal matter; a second sheet portion 112 having a cut-out window portion 112*a*; a third sheet portion 113; and a fourth sheet portion 114. For facilitation of the folding process of the postal matter with accuracy, the perforation 110 is provided at a boundary between the first sheet portion 111 and the second sheet portion 112 and a boundary between the second sheet portion 112 and the third sheet portion 113. The first sheet portion 111 and the fourth sheet portion 114 are folded and laid over the second sheet portion 112 and the third sheet portion 113, respectively, to form a second pocket and a first pocket. The first sheet portion 111 and the fourth sheet portion 114 are elongated in the direction of X and thus longer than the second sheet portion 112 and the third sheet portion 113, so as to have extended portions 111*a*, 114*a*, respectively. Also, the first sheet portion 111 and the fourth sheet portion 114 have widths in the direction of Y somewhat shorter than widths in the direction of Y of the second sheet portion 112 and the third sheet portion, respectively.

The extended portions 114*a* of the fourth sheet portion 114 are folded to the inside and laid over the third sheet portion 113. Then, the extended portions 114*a* of the fourth sheet portion 114 and the ends of the third sheet portion 113 in the direction of X are fixed together by means of a glue, a double-coated tape or the like, to form a first pocket. Then, the disc-shaped cup 92 of the protruding postal matter case 91 receiving therein the disc-like article is fitted in the cut-out window portion 112*a* of the second sheet portion 112, as shown in FIG. 25(*a*). With the V-shaped notch of the flange portion 92*a* aligned with a positioning dotted line, not shown, the case is fixed to the second sheet portion 112. Then, the extended portions 111*a* of the first sheet portion 111 are folded to the inside and laid over the second sheet portion 112. Then, the extended portions 111*a* of the first sheet portion 111 and the ends of the second sheet portion 112 in the direction of X are fixed together by means of the glue, the double-coated tape or the like, to form a second pocket, as shown in FIG. 25(*b*). When necessary, a letter or the like is inserted in the first pocket or the second pocket. Finally, the second sheet portion 112 and the third sheet portion are folded and piled up to bring the first pocket and the second pocket to lie over each other and then are closed in the form of a postal matter by means of the glue, the double-coated tape or the like.

Figure 26A:
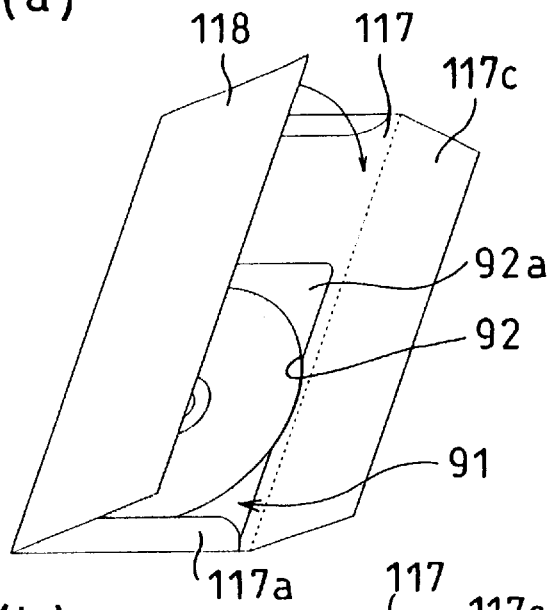
Figure 26B:
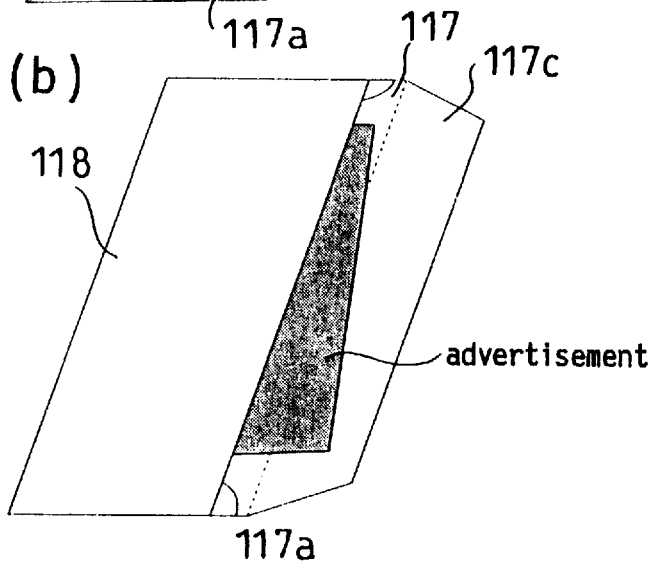
Figure 26C:
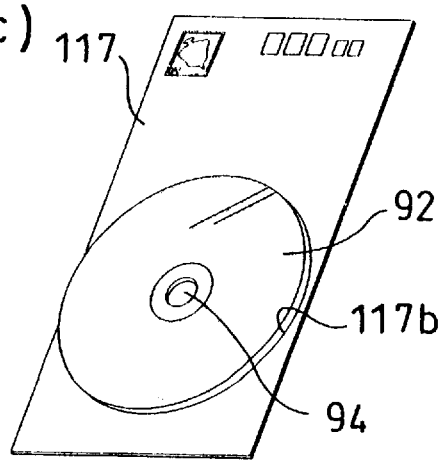

FIGS. 26(*a*) to 26(*c*) are illustrations of still another embodied form of the protruding postal matter case 91 receiving therein the disc-like article fitted to the postal matter. The postal matter is a sidelong opening envelop of a standard-size mail comprising a first sheet portion 118 forming a part of the postal matter; and a second sheet portion 117 laid over the first sheet portion 118 and having a circular window 117*a* from which the protruding postal matter case 91 can project. Further, the second sheet portion 117 has extended portions 117*a* of overlap widths for forming a pocket together with the first sheet portion 118; and a flap 117*c* to close in the form of a postal matter.

In FIG. 26(*a*), the protruding postal matter case 91 receiving therein the disc-like article is first fitted in the circular window of the second sheet portion 117. Then, the extended portions 117*a* of the second sheet portion are folded to the inside, and the first sheet portion 118 is laid over the second sheet portion. Then, the extended portions 117*a* are fixed to the first sheet portion 118 by means of a glue or the like, to form a pocket. The extended portions 117*a* are not indispensable for forming the pocket. The pocket may be formed by fixing the ends of the first sheet portion 118 directly to the associated ends of the second sheet portion 117 by means of the glue or the like.

In FIG. 26(*b*), a paper, such as an advertisement, a catalog or a letter, is inserted in the pocket. Then, the flap 117*c* is folded toward the second sheet portion 118 to overlap with the second sheet portion 118 and is fixed on the sheet portion 118 to close in the form of a postal matter.

Thus, the postal matter is produced in which the cup 92 of the protruding postal matter case 91 protrudes from the circular window 117*b* of the second sheet portion 117, as shown in FIG. 26(*c*).

It should be noted that the means for closing the sheet in the form of a postal matter and the means for fixing the protruding postal matter case to the sheet forming a part of the postal matter may be selectively used on an as needed basis in putting the present invention into practice, which are commonly applicable to all embodiments.

Figure 27A:
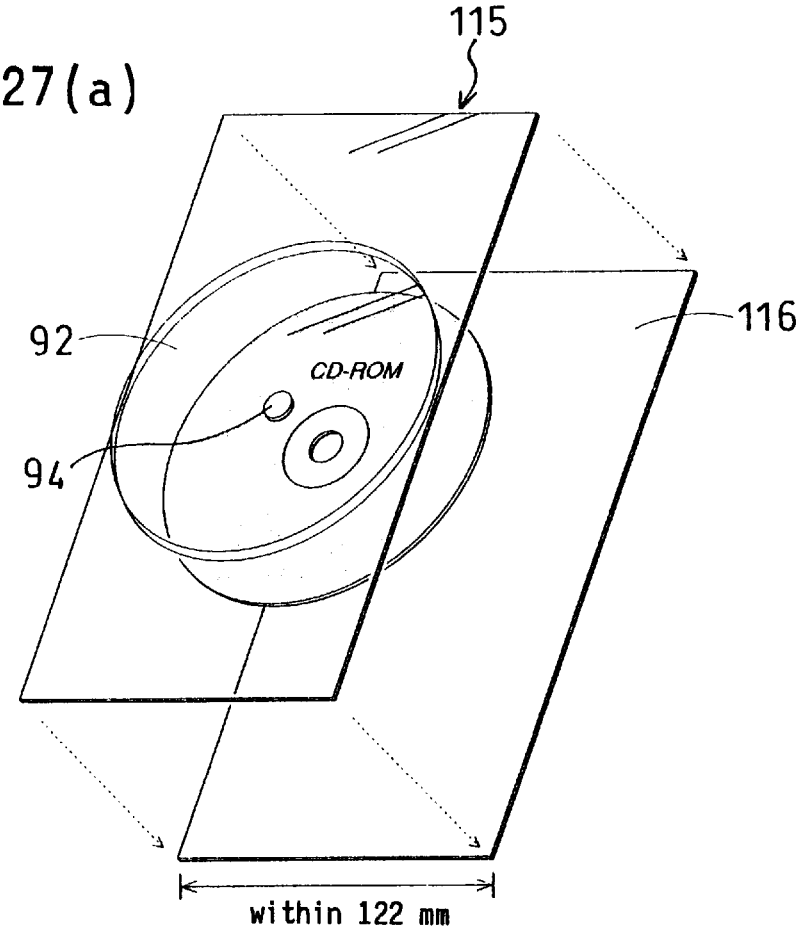
FIGS. 27(*a*), 27(*b*), 28(*a*) and 28(*b*) are perspective views of an example of the third protruding postal matter case of the present invention.
Figure 27B:
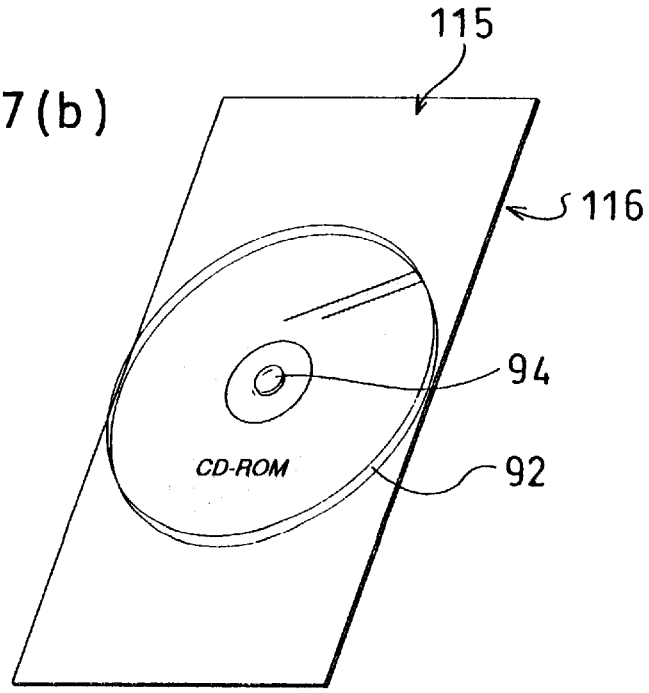

A protruding postal matter case 115 shown in FIGS. 27(*a*) to 28(*b*) is an example of the protruding postal matter case 91 which is formed as a postal matter forming sheet in itself by enlarging the flange portion 92*a* of the protruding postal matter case 91 shown in FIGS. 15 to 16(*b*) up to the size of the standard-size mail.

In FIGS. 27(*a*) and 27(*b*), the protruding postal matter case comprises a first sheet 115 of a size of the standard-size mail having a disc-shaped cup portion 92 having a disc-like inner space for receiving therein a disc-like article of a given thickness having at its center a through bore of a given size; and a cylindrical projection 94 having such a diameter as to fit in the given sized through bore of the disc-like article in such relation as to be resistant to disengagement therefrom and a height larger than the given thickness of the disc-like article and projecting into the inner space of the disc-shaped cup portion 92 at the center thereof. The inner space of the disc-shaped cup portion 92 is closed by a second sheet 116 forming a part of the postal matter. Thus, the second sheet 116 covers a surface of the disc-like article on an opening side of the protruding postal matter case 115 having the disc-like inner space receiving the disc-like article therein, so that when the case is delivered as a postal matter, both sides of the disc-like article are avoided being scratched. The second sheet 116, which is basically required to have a size to cover the disc-like inner space of the disc-shaped cup portion 92, should preferably have a size of the standard-side mail equal to the first sheet 115, to prevent the second sheet 116 from fallen off from the first sheet 115. Further, the first sheet 115 is preferably put into absolute adherence to the second sheet 116 by use of a glue or a double-coated tape or by means of the thermocompression bonding.

Figure 28A:
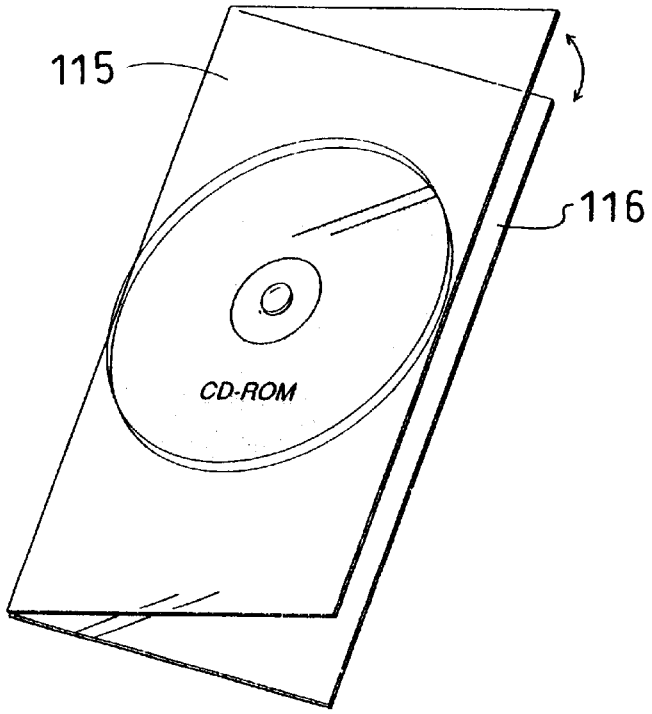
Figure 28B:
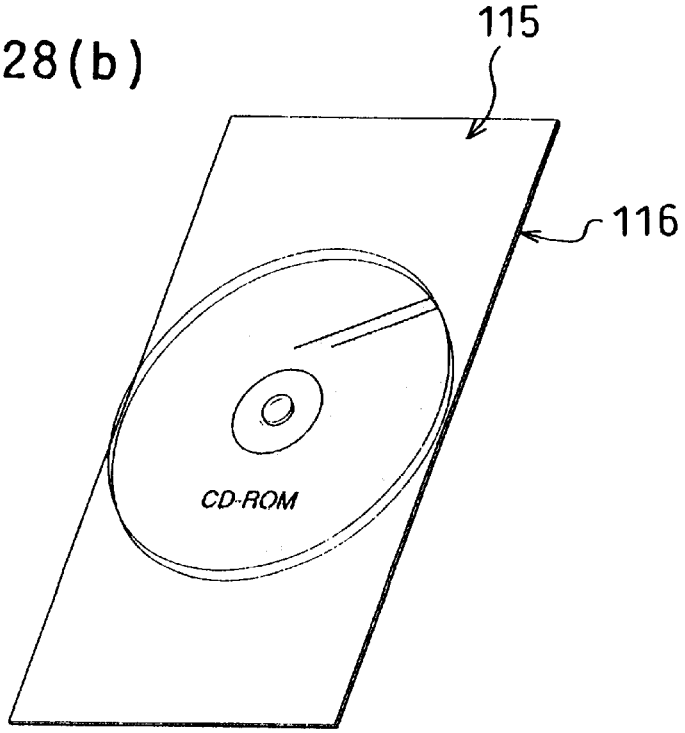
Figure 29:
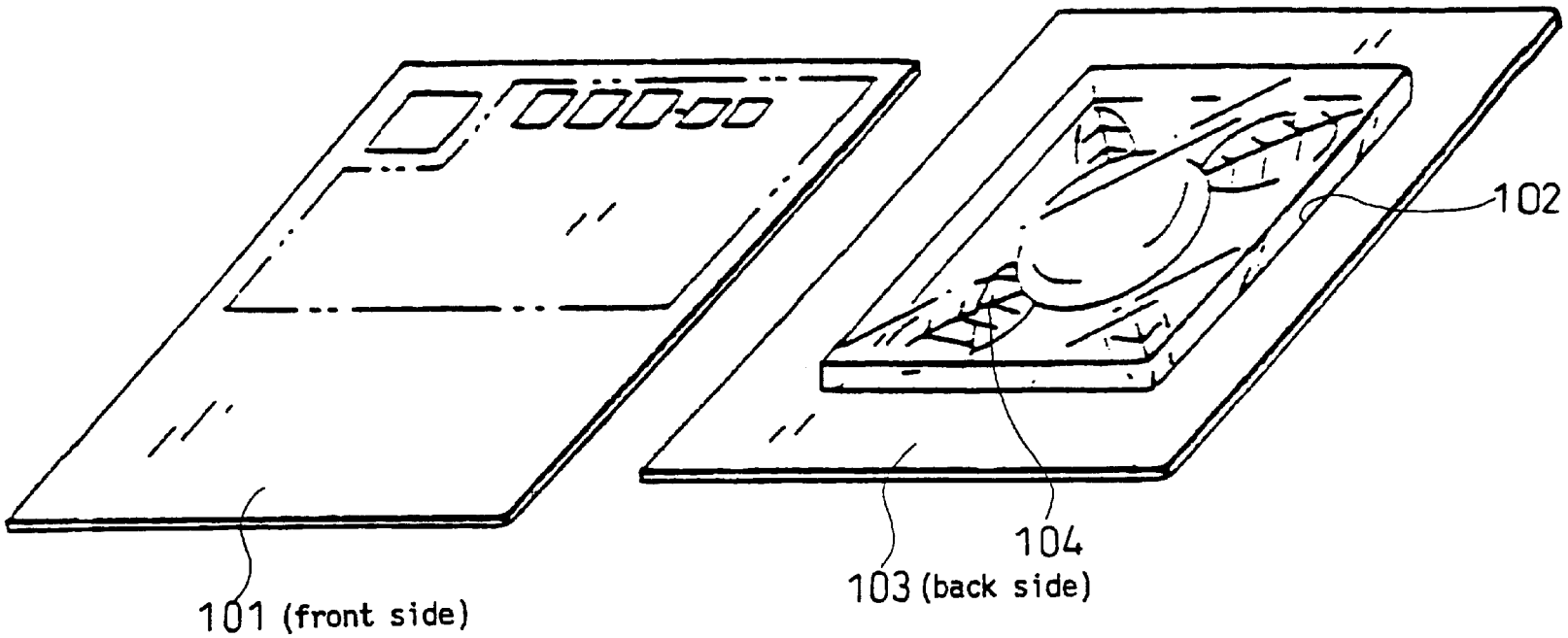
FIGS. 29, 30(*a*) and 30(*b*) are examples of conventional types of protruding postal matter cases.
Figure 30A:
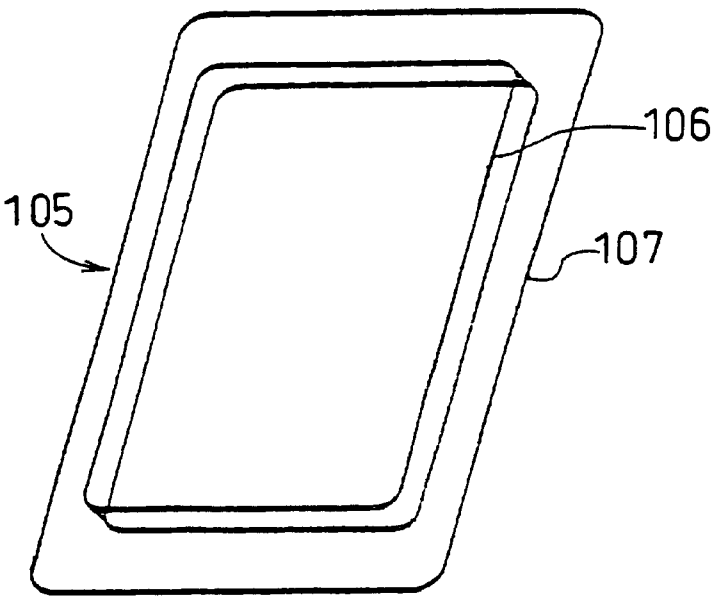
(Prior Art) Fig.30(a)
Figure 30B:
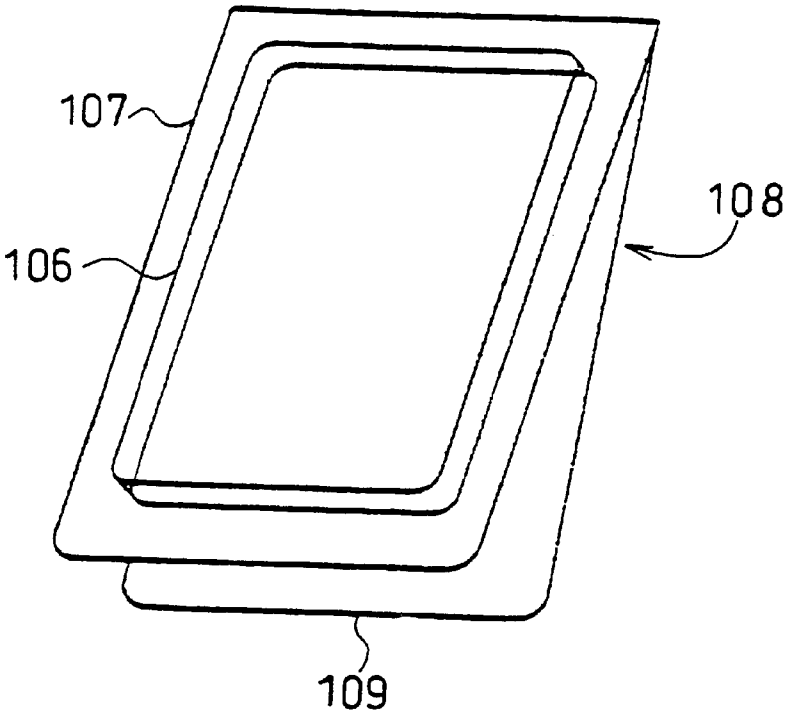

In FIGS. 28(*a*) and 28(*b*), the first sheet 115 and the second sheet 116 are formed in one piece. After the disc-like article is received in the disc-shaped cup portion 92, the first sheet 115 is folded over the second sheet 116 to be closed via the thermocompression bonding or equivalent. The materials which may be used for this embodiment include plastics of a variety of resins, of which an acrylic board and the like is preferable, from the viewpoint of hardness.

The protruding postal matter case 115 thus structured has the cylindrical projection having such a diameter as to fit in the given sized through bore of the disc-like article in such relation as to be resistant to disengagement therefrom and a height larger than the given thickness of the disc-like article, as the protruding postal matter case 91. Therefore, the disc-like article received in the inner space of the disc-shaped cup is prevented from easily disengaging from the protruding postal matter case and accordingly the postal matter case is suitable for the mass production. Further, since the standard-size postal matter can be made simply by closing the inner space of the disc-shaped cup portion by the second sheet forming a part of the postal matter, the disc-like article can be easily included in the postal matter and accordingly this postal matter case is more suitable for the mass production. Also, since the postal matter case thus produced is a standard-size mail, it can be mailed cheaply and thus is suitable for a direct mail.

Capability of Exploitation in Industry

The present invention is useful as a protruding postal matter case which is fixed between the first sheet portion forming a part of a postal matter and the second sheet portion having the cut-out window portion and laid over the first sheet portion to be closed in the form of the postal matter and protrudes from the cut-out window portion, and is particularly suitable for automation for mass production thereof.

What is claimed is:

1. A postal package, comprising:

a first sheet portion;

a second sheet portion having a cut-out window; and an inner case disposed between said first and second sheet portions, said inner case comprising a cup having a mouth and an outwardly extending flange portion around the mouth, said cup being dimensioned to protrude through said cut-out window;

said inner case further including a cover for closing the mouth of the cup, at least one of said cup and said cover including engaging structure for mutual engagement of the cup and the cover, said engagement structure comprising inter-engaging surfaces of the cup and the cover.

2. A postal package according to claim 1, wherein the engaging structure comprises at least one notch arranged at a position in the cover to be laid over the flange portion of the cup, the flange portion of the cup being inserted in the notch.

3. A postal package according to claim 1, wherein the cover is glued to the first sheet portion.

4. A postal package according to claim 1, wherein said case is formed from one sheet.

5. A postal package according to claim 1, wherein the engaging structure comprises at least one notch arranged at a position in the flange portion of the cup to be laid over a marginal portion of the cover, the marginal portion of the cover being inserted in the notch.

6. A postal package according to claim 1, wherein the flange portion of the cup is in close contact with peripheral structure defining the cut-out window of the second sheet portion.

7. A postal package according to claim 1, wherein at least one of a marginal portion of the cover and the flange portion of the cup is inserted in notches at positions in a neighborhood of a larger diameter side of the first sheet portion to be laid over the cut-out window portion of the second sheet, portion, so as to be fixed in the first sheet portion.

8. A postal package according to claim 1, wherein said first and second sheet portions are part of a single folded sheet.

9. A postal package according to claim 1, wherein the cup and the cover are transparent.

10. A postal package, comprising:

a first sheet portion having a first cut-out window portion;

a second sheet portion having a second cut-out window portion;

an inner case between the first and second sheet portions, the inner case including a first cup and a cover;

the first cup having a first mouth and an outwardly extending first flange portion around the first mouth;

the cover closing the the mouth of the first cup, said cover including a second cup having a second mouth and a second flange portion around the second mouth;

engaging structure for holding the cup and the cover together, said engaging structure including inter-engaging surfaces of the cup and cover, the flange portions of the cup and the cover being sandwiched between the first and second sheet portions with the first and second cups protruding through said cut-out window portions.

11. A postal package according to claim 10, wherein the cup and the cover are transparent.

12. A postal package according to claim 10, wherein said case is formed from one sheet.

13. A postal package according to claim 10, wherein the engaging structure comprises at least one notch arranged at a position in the cover to be laid over the flange portion of the cup, the flange portion of the cup being inserted in the notch.

14. A postal package according to claim 13, wherein said first and second sheet portions are part of a single folded sheet.

15. A postal package according to claim 13, wherein said case is formed from one sheet.

16. A postal package according to claim 10, wherein said first and second sheet portions are part of a single folded sheet.

17. A postal package according to claim 10, wherein the flange portions of the first and second cups are in close contact with peripheral structures defining the first and second cut-out windows of the first and second sheet portions.

* * * * *